US006714877B1

(12) United States Patent
Lang

(10) Patent No.: US 6,714,877 B1
(45) Date of Patent: Mar. 30, 2004

(54) METHOD FOR CORRECTING COMBUSTION EFFLUENT DATA WHEN USED FOR INPUT-LOSS PERFORMANCE MONITORING OF A POWER PLANT

(75) Inventor: Fred D Lang, San Rafael, CA (US)

(73) Assignee: Exergetic Systems LLC, San Rafael, CA (US)

( * ) Notice: Subject to any disclaimer, the term of this patent is extended or adjusted under 35 U.S.C. 154(b) by 13 days.

(21) Appl. No.: 10/087,879

(22) Filed: Mar. 1, 2002

Related U.S. Application Data

(63) Continuation-in-part of application No. 09/273,711, filed on Mar. 22, 1999, which is a continuation-in-part of application No. 09/047,198, filed on Mar. 24, 1998, application No. 10/087,879, which is a continuation-in-part of application No. 09/630,853, filed on Aug. 2, 2000, application No. 10/087,879, which is a continuation-in-part of application No. 09/827,956, filed on Apr. 4, 2001, which is a continuation-in-part of application No. 09/759,061, filed on Jan. 11, 2001, which is a continuation-in-part of application No. 09/273,711, which is a continuation-in-part of application No. 09/047,198, application No. 10/087,879, which is a continuation-in-part of application No. 09/971,527, filed on Oct. 5, 2001, which is a continuation-in-part of application No. 09/273,711, which is a continuation-in-part of application No. 09/047,198, said application No. 09/971,527, said application No. 09/971,527, filed on Oct. 5, 2001, and a continuation-in-part of application No. 09/827,956, filed on Apr. 4, 2001, which is a continuation-in-part of application No. 09/759,062, filed on Jan. 11, 2001, which is a continuation-in-part of application No. 09/273,711, filed on Mar. 22, 1999, which is a continuation-in-part of application No. 09/047,198, filed on Mar. 24, 1998.

(60) Provisional application No. 60/147,717, filed on Aug. 6, 1999.

(51) Int. Cl.[7] ..... G01N 31/00
(52) U.S. Cl. ..... 702/32; 700/274
(58) Field of Search ..... 702/32, 22; 700/287, 700/274; 454/192

(56) References Cited

U.S. PATENT DOCUMENTS 5,306,209 A * 4/1994 Lang ..... 454/209
5,327,356 A * 7/1994 Lang et al. ..... 702/22
5,367,470 A * 11/1994 Lang ..... 700/274
5,790,420 A * 8/1998 Lang ..... 700/287

OTHER PUBLICATIONS

D.F. Shanno and K.H. Phua, "Algorithm 500, Minimization of Unconstrained Multivariate Functions", ACM Transactions on Mathematical Software, Vol 2, No 1, Mar. 1976, pp 87–94.

(List continued on next page.)

*Primary Examiner*—John Barlow
*Assistant Examiner*—Victor J. Taylor

(57) ABSTRACT

The operation of a fossil-fueled thermal system is quantified by a method for determining correction factors to Choice Operating Parameters, including effluent $CO_2$ and other parameters, such that combustion stoichiometric consistency and thermodynamic conservations are both achieved. Correcting Choice Operating Parameters is accomplished through multidimensional einimization techniques operating on certain System Effect Parameters. The corrected Choice Operating Parameters may then be supplied to Input/Loss methods as used to monitor and improve system heat rate.

20 Claims, 6 Drawing Sheets

OTHER PUBLICATIONS

D.F. Shanno and K.H. Phua, "Remarks on Algorithm 500, Minimization of Unconstrained Multivariate Functions", ACM Transactions on Mathematical Software, Vol 6, No 2, Dec. 1980, pp 618–622.

W.L. Goffe, G.D. Ferrier and J Rogers, "Global optimization of Statistical Functions with Simulated Annealing", Journal of Econometrics, Vol 60, No 1/2, Jan./Feb. 1994, pp. 65–100.

A. Corana, M. Marchesi, C. Martin and S. Ridella, "Minimizing Multimodal Functions of Continuous Variables with the 'Simulated Annealing', Algorithm", ACM Transactions on Mathematical Software, Vol 13, No 3, Sep. 1987, pp 262–280.

F. James, "A Review of Pseudorandom Number Generators", Computer Physics Communications, Vol 60, 1190, pp 329–344.

W.H. Press, S.A. Teukolsky, W.T. Vettering and B.P. Flannery, 'Numerical Recipes in FORTRAN 77, The Art of Computing', Cambridge University Press, Cambridge and New York (1992), Chapter 9.6 on Newton–Raphson Method for Nonlinear Systems of Equations and Chapter 9.7 on Globally Convergent Methods for Nonlinear.

* cited by examiner

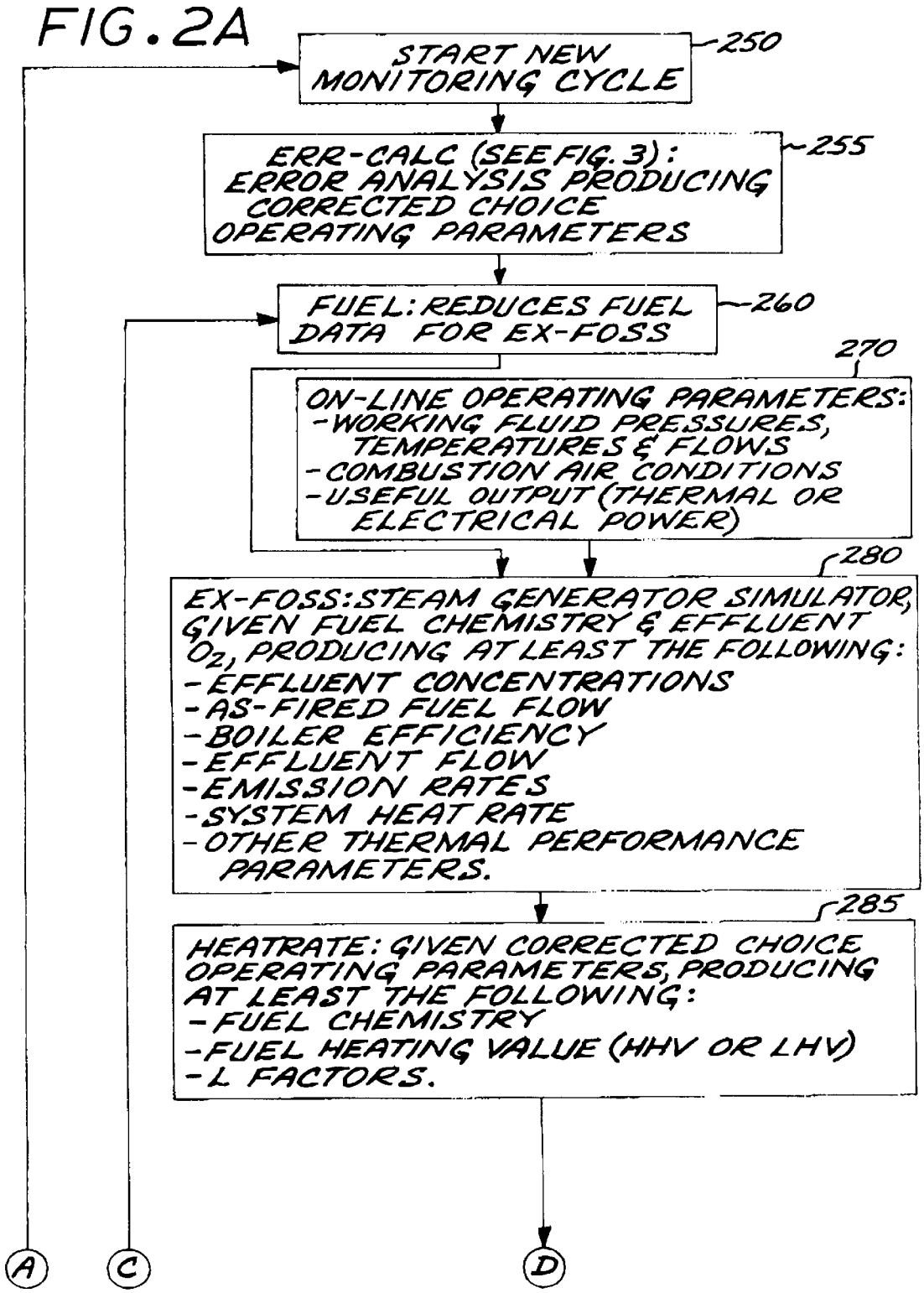
FIG. 2A
START NEW MONITORING CYCLE
250
ERR-CALC (SEE FIG. 3): ERROR ANALYSIS PRODUCING CORRECTED CHOICE OPERATING PARAMETERS
255
FUEL: REDUCES FUEL DATA FOR EX-FOSS
260
270
ON-LINE OPERATING PARAMETERS:
-WORKING FLUID PRESSURES, TEMPERATURES & FLOWS
-COMBUSTION AIR CONDITIONS
-USEFUL OUTPUT (THERMAL OR ELECTRICAL POWER)
280
EX-FOSS: STEAM GENERATOR SIMULATOR, GIVEN FUEL CHEMISTRY & EFFLUENT $O_2$, PRODUCING AT LEAST THE FOLLOWING:
-EFFLUENT CONCENTRATIONS
-AS-FIRED FUEL FLOW
-BOILER EFFICIENCY
-EFFLUENT FLOW
-EMISSION RATES
-SYSTEM HEAT RATE
-OTHER THERMAL PERFORMANCE PARAMETERS.
285
HEATRATE: GIVEN CORRECTED CHOICE OPERATING PARAMETERS, PRODUCING AT LEAST THE FOLLOWING:
-FUEL CHEMISTRY
-FUEL HEATING VALUE (HHV OR LHV)
-L FACTORS.
A
C
D

METHOD FOR CORRECTING COMBUSTION EFFLUENT DATA WHEN USED FOR INPUT-LOSS PERFORMANCE MONITORING OF A POWER PLANT

This application is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, for which priority is claimed.

This application is also a Continuation-In-Part of U.S. patent application Ser. No. 09/630,853 filed Aug. 2, 2000, for which priority is claimed and is incorporated herein by reference in its entirety; application Ser. No. 09/630,853 claims the benefit of U.S. Provisional Patent Application Serial No. 60/147,717 filed Aug. 6, 1999, for which priority is claimed.

This application is also a Continuation-In-Part of U.S. patent application Ser. No. 09/827,956 filed Apr. 4, 2001, for which priority is claimed and is incorporated herein by reference in its entirety; application Ser. No. 09/827,956 which, in turn, is a Continuation-In-Part of U.S. patent application Ser. No. 09/759,061 filed Jan. 11, 2001, for which priority is claimed; application Ser. No. 09/759,061 which, in turn, is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, for which priority is claimed.

This application is also a Continuation-In-Part of U.S. patent application Ser. No. 09/971,527 filed Oct. 5, 2001, for which priority is claimed and is incorporated herein by reference in its entirety; application Ser. No. 09/971,527 which, in turn, is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, for which priority is claimed; application Ser. No. 09/971,527 is also a Continuation-In-Part of U.S. patent application Ser. No. 09/630,853 filed Aug. 2, 2000, for which priority is claimed and is incorporated herein by reference in its entirety; application Ser. No. 09/971,527 is also a Continuation-In-Part of U.S. patent application Ser. No. 09/827,956 filed Apr. 4, 2001, for which priority is claimed and is incorporated herein by reference in its entirety; application Ser. No. 09/827,956 which, in turn, is a Continuation-In-Part of U.S. patent application Ser. No. 09/759,061 filed Jan. 11, 2001, for which priority is claimed; application Ser. No. 09/759,061 which, in turn, is a Continuation-In-Part of U.S. patent application Ser. No. 09/273,711 filed Mar. 22, 1999, for which priority is claimed and is incorporated herein by reference in its entirety; application Ser. No. 09/273,711 which, in turn, is a Continuation-In-Part of U.S. patent application Ser. No. 09/047,198 filed Mar. 24, 1998, for which priority is claimed.

This invention relates to a fossil-fired thermal system such as a power plant or steam generator, and, more particularly, to a method for determining correction factors to a set of "Choice Operating Parameters", including effluent concentrations, such that combustion stoichiometric consistency and thermodynamic conservations of the system are both achieved. Correcting Choice Operating Parameters is accomplished through multidimensional minimization techniques operating on "System Effect Parameters" which are reflective of the system at large including system heat rate. The corrected Choice Operating Parameter may then be supplied to Input/Loss methods as used to determine fuel chemistry, heating value, fuel flow and other parameters for the monitoring and improvement of system heat rate.

BACKGROUND OF THE INVENTION

The importance of accurately determining system heat rate is critical to any thermal system (heat rate being inversely related to system thermal efficiency, common units of measure for heat rate are Btu/hour per kilowatt, or Btu/kWh). If practical hour-by-hour reductions in heat rate are to be made, and/or problems in thermally degraded equipment are to be found and corrected, then accuracy in determining system heat rate is a necessity. Accurate system heat rates using "Input/Loss methods" are achievable given input data with no discernable error. Specifically, "The Input/Loss Method" and its associated technologies are described in the following U.S. patent applications: Ser. No. 09/273,711 (hereinafter termed '711), Ser. No. 09/630,853 (hereinafter termed '853), Ser. No. 09/827,956 (hereinafter termed '956), and Ser. No. 09/971,527 (hereinafter termed '527); and in their related provisional patent applications and Continuation-In-Parts. Rudimentary Input/Loss methods are described in U.S. Pat. No. 5,367,470 issued Nov. 22, 1994 (hereinafter termed '470), and in U.S. Pat. No. 5,790,420 issued Aug. 4, 1998 (hereinafter termed '420). In addition to The Input/Loss Method as described in '711, the subject of the present invention relates to any method which uses measurements of effluent concentrations, typically $CO_2$ and $O_2$, and other non-flow "Operating Parameters", and when using this data determines one or more of the following: fuel flow, effluent flow, emission rates, fuel chemistry, fuel heating value, boiler efficiency, and/or system heat rate. Meanings of terms specific to this invention and delineated by quote marks are defined below.

Two highly sensitive inputs to Input/Loss methods are the $CO_2$ and $H_2O$ effluent concentrations as measured, or as otherwise determined, at the boundary of the system. There are other sensitive inputs such as effluent $O_2$. The importance of accurately measuring effluent concentrations and Operating Parameters has been discussed by the present inventor in his U.S. patents and applications cited herein. His works have stressed the importance of such measurement accuracy, especially when monitoring a power plant in real-time, for making essentially continuous improvements. Such concern for measuring effluents in a direct manner, as required by '470 and '420, resulted in the invention of a high accuracy infrared instrument described in U.S. Pat. No. 5,327,356, whose technology was supported when applied to coal-fired systems by U.S. Pat. No. 5,306,209.

The invention of '470 is noteworthy as background for this invention for it teaches to repetitively adjust, or iterate, on "an assumed water concentration in the fuel until consistency is obtained between the measured $CO_2$ and $H_2O$ effluents and those determined by stoichiometrics based on the chemical concentration of the fuel". Some aspects of '470 are dependent upon high accuracy directly measured $CO_2$ and $H_2O$ effluent concentrations. The difficulty is that high accuracy measurements may not be possible. Another difficulty with the details of '470 lies with the fact that adjusting fuel water as taught in '470, which alters the computed effluent water, has no prima facie effect on a dry-base effluent $CO_2$. It is true, for example, that if fuel water is increased, the relative fraction of the other fuel's constituents, per mole of total As-Fired fuel, will decrease assuming that the fuel's other constituents, nitrogen, oxygen, carbon, hydrogen, sulfur and ash, remain proportionally constant to each other. However, it would be unusual that any given fuel water adjustment would produce an exactly consistent effluent $CO_2$ and $O_2$; with the exception where the dry chemistry is constant. Further, if the fuel has a variable ash content, ash having a pure dilutive or concentrative influence on fuel chemistry and fuel heating value, then such a variable effect could not possibly be determined by merely iterating on fuel water. A higher assumed fuel water may decrease a wet-base effluent $CO_2$, but the actual fuel could contain much lower ash, thus actually increasing the amount of fuel carbon relative to the whole. The approach of simple water iterations of the '470 patent is useful in certain situations, such as where the coal fuel bears little and constant ash, and, further, where high accuracy and consistent effluent $CO_2$ and $H_2O$ measurements are made. However, '470 has limitations given a lack of technology in assuring consistency in combustion stoichiometrics and for relying on high accuracy effluent measurements.

The invention of '420 extends the approach of '470 to include combustion turbine systems. The '420 patent is concerned with methods for improving heat rate, determining effluent flows and determining fuel flow of fossil-fired systems through an understanding of the total fuel energy flow (fuel flow rate times heating value). '420 explains that the molar quantity of fuel water "is iterated until convergence is achieved"; i.e., using direct, unaltered, effluent measurements resulting in an As-Fired heating value and fuel flow rate. Again, as water is altered, the aggregate of all other fuel constituents are altered in opposite fashion to maintain a normalized unity moles of fuel. As with the approach of '470, '420 requires high accuracy instrumentation, stating "the apparatus necessary for practicing the present invention includes utilization of any measurement device which may determine the effluent concentrations of $H_2O$ and $CO_2$ to high accuracy". When considering direct effluent measurements required for Input/Loss methods, such as effluent concentrations of $CO_2$, $O_2$, and other Operating Parameters, measurement errors rarely cancel and no single instrument has perfect accuracy.

The problem which is not addressed by '470 or '420 Input/Loss methods is that great sensitivity may exist between an effluent concentration measurement and a parameter which effects system heat rate. This is best illustrated by the sensitivity effluent $CO_2$ has on a computed heating value: a 1.0% Δmolar/molar change in $CO_2$ will produce a 2.7% change in heating value for a typical Powder River Basin coal. This typically implies 270 ΔBtu/kWh in heat rate, which may be worth at least $5 million/year in fuel costs for a 600 Mwe coal-fired system. Further, it is the nature of power plant stoichiometrics that essentially any selection of Choice Operating Parameters have interdependencies. A 1.0% change in $CO_2$ may be easily caused by non-fuel induced changes within the system: in air pre-heater leakage; in Forced Draft Fan bias effecting combustion air flow; in burner configurations; in fuel water content; and so forth. A method is needed in which such inter-dependencies are considered.

Complete thermodynamic understanding of fossil-fired thermal systems, for the purposes of improving heat rate and accuracy in regulatory reporting of data, requires the determination of fuel flow rate, fuel chemistry, fuel heating value, boiler efficiency, total effluent flow, emission rates of the common pollutants, and system heat rate. When determining these quantities, there is need to improve combustion stoichiometric consistency and thermodynamic conservations as affected by base inputs, including effluent concentrations, recognizing such inputs have inaccuracies.

There is no known art related to this invention. Although the technologies of '711, '853, '956 and '527 support this invention, they integrally employ effluent concentration measurements and other Operating Parameters, or their assumptions, whose technologies would benefit greatly, as would all Input/Loss methods, if such employments were systemically corrected in a manner as to assure combustion stoichiometric consistency and thermodynamic conservations of the thermal system.

SUMMARY OF THE INVENTION

This invention relates to a fossil-fired thermal system such as a power plant or steam generator, and, more particularly, to a method for determining correction factors to such a system's Choice Operating Parameters such that combustion stoichiometric consistency and thermodynamic conservations are both achieved; corrected Choice Operating Parameters being then supplied to Input/Loss methods which may then be used to determine fuel flow, effluent flow, emission rates, fuel chemistry, fuel heating value, boiler efficiency, and/or system heat rate for on-line monitoring and improvement of the system.

This invention adds to the technology associated with Input/Loss methods. Specifically The Input/Loss Method has been applied through computer software, installable on a personal computer termed a "Calculational Engine", and has been demonstrated as being highly useful to power plant engineers. The Calculational Engine receives data from the system's data acquisition devices. The Calculational Engine's software consists of the EX-FOSS, FUEL and HEATRATE programs described in '711, and in FIG. 2 herein, and the ERR-CALC program described in FIG. 3 herein. ERR-CALC and HEATRATE now incorporate the teachings of this invention. The Calculational Engine continuously monitors system heat rate on-line, i.e., in essentially "real-time", as long as the thermal system is burning fuel. The application of this invention to The Input/Loss Method as taught in '711 and installed as part of the Calculational Engine significantly enhances the power plant engineer's ability to improve system heat rate.

In applying its methodologies, this invention teaches the use of Method Options, System Options and Analysis Options whose selections by the user of this invention allow for a systematic approach to the determination and application of correction factors. These options help assure consistent stoichiometrics and thermodynamic conservations; they provide flexibility for the power plant engineer in selecting and correcting Choice Operating Parameters as some level of corrections will always be needed if computing fuel chemistry from Choice Operating Parameters.

Method Options relate to the specific numerical techniques used by ERR-CALC in determining correction factors to effluents and Operating Parameters to be optimized; all are used to obtain accurate fuel chemistry. System Options relate to how the Calculational Engine approaches system stoichiometrics in determining fuel chemistry and heating value, specifically it controls procedures in the HEATRATE program. Analysis Options relate to mechanistic computing techniques and specialized computations associated with the "Fuel Iterations" and the ERR-CALC program; e.g., at what frequency should effluent corrections be determined, how to process faulted conditions, and so forth.

The present invention provides a procedure for determining correction factors to a fossil-fired thermal system's Choice Operating Parameters.

The present invention assures that changes in the values associated with a selection of Choice Operating Parameters impact system heat rate through System Effect Parameters, and not as individual and disconnected quantities; in other words, System Effect Parameters must be dependent on the selected Choice Operating Parameters.

The present invention, given a procedure for determining correction factors to Choice Operating Parameters, teaches how these factors may be applied using Method Options, System Options and Analysis Options developed for this invention.

Other advantages of the present invention will become apparent when its general methods are considered in conjunction with the accompanying drawings and the related inventions of '711, '853, '956 and '527.

This invention has been reduced to practice and installed for demonstration at a power plant to determine the operability and functionality of this invention. This demonstration has produced outstanding results.

BRIEF DESCRIPTION OF THE DRAWING

FIGS. 2A and 2B is a block diagram of the general interactions and functions of the computer programs ERR-CALC, FUEL, EX-FOSS, and HEATRATE; herein collectively referred to as FIG. 2. FIG. 2 illustrates the Fuel Iterations involving FUEL, EX-FOSS, and HEATRATE.

FIG. 5 illustrates results of correcting effluent concentrations as taught by this invention, thus allowing accurate fuel chemistries and heating values to be determined (even given a rapid change in the fuel mix) using The Input/Loss Method resulting in reliable computed fuel flows and system heat rates.

DESCRIPTION OF THE PREFERRED EMBODIMENT

Figure 1:
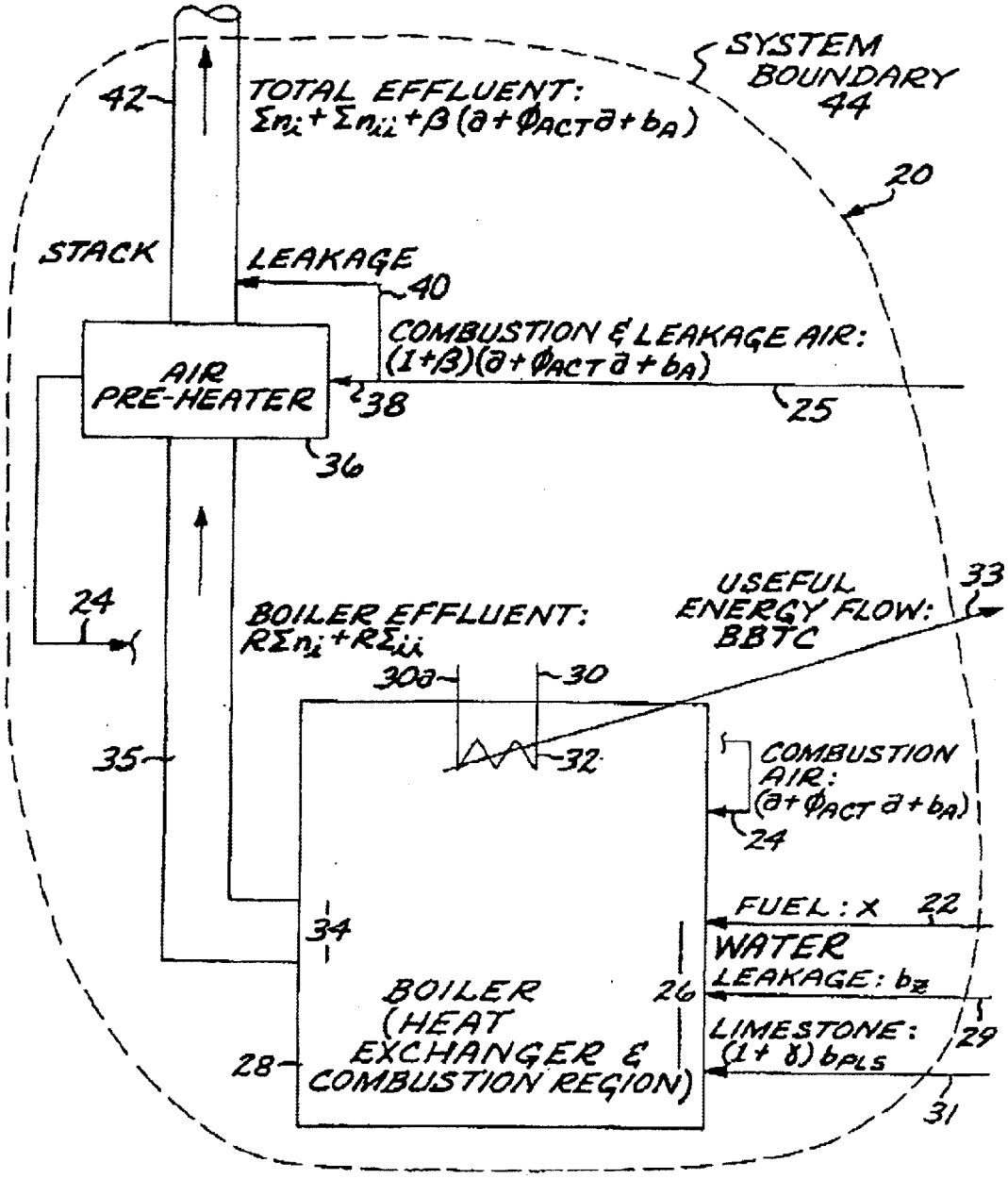
FIG. 1 is a schematic representation of a fossil-fired thermal system illustrating the application of stoichiometric relationships, and also contains definitions of terms used herein.

To assure an appropriate teaching of this invention, its description is divided into sub-sections. The first presents nomenclature, definitions of equation terms, typical units of measure, and meaning of terms used herein (such as Choice Operating Parameters and System Effect Parameters). The next sub-sections present the meaning of thermodynamic conservations in the context of The Input/Loss Method as taught in '711, explaining dependency on consistency of combustion stoichiometrics. Subsequent sub-sections explain how such consistency is achieved through application of multidimensional minimization techniques, and Method, System and Analysis Options; then a summary. Multidimensional minimization techniques are taken from the mathematical field generally termed numerical optimization. Symbolic nomenclature follows '711 and '853 unless otherwise defined herein. The present invention it expands the utility of Input/Loss methods, and specifically builds upon and expands the utility of The Input/Loss Method described in '711, '853, '956, '527 and related provisional patent applications and Continuation-In-Parts.

Definitions of Equation Terms with Typical Units of Measure

Stoichiometric Terms:

a=Molar fraction of combustion $O_2$ input to the system; moles/base.

$a\beta$=$O_2$ entering with system air leakage (typically via the air pre-heater); mole/base.

$a_{Dry\text{-}theor}$=Molar fraction of combustion $O_2$ input to the system required for theoretical combustion associated with Dry (water free) fuel; moles/base.

$A_{Act}$=Concentration of $O_2$ in combustion air local to (and entering) the system; molar ratio.

$b_A$=Moisture in the entering combustion air; moles/base.

$b_A\beta$=Moisture entering with system air leakage; mole/base.

$b_Z$=Water/steam in-leakage from the working fluid; moles/base.

$b_{PLS}$=Fraction of Pure LimeStone ($CaCO_3$) required for zero CaO production; moles/base.

$d_{Act}$=Total effluent $CO_2$ at the system's boundary; moles/base.

$g_{Act}$=Effluent $O_2$ at the system's boundary, without system air leakage; moles/base.

$G_{Act}$=Total effluent oxygen at the system's boundary ($g_{Act}+a\beta$); moles/base.

$j_{Act}$=Effluent water at the system's boundary, without moist air leakage; moles/base.

$J_{Act}$=Total effluent water at the system's boundary ($j_{Act}+b_A\beta$); moles/base.

$J_{theor}$=Total effluent water at the boundary based on theoretical combustion; moles/base.

$n_i$=Molar quantities of combustion dry gas products at system boundary without air leakage specifically those products associated with the following quantities: $d_{Act}$, $e_{Act}$, f, $g_{Act}$, h, $k_{Act}$, l, m, p, q, t and u; see FIG. 1; moles/base.

$n_{ii}$=Molar quantities of non-gas combustion products at system boundary, specifically those products associated with the following quantities: $j_{Act}$, $x\alpha_{10}$, $\sigma b_{PLS}$, $(1.0-\sigma+\gamma)b_{PLS}$, $x\alpha_{CaCO3}$ and v; see FIG. 1; moles/base.

$N_k$=Molecular weight of compound k.

$R_{Act}$=Ratio of moles of dry gas from the combustion process before entering the air pre-heater to gas leaving, defined as the air pre-heater leakage factor, molar ratio.

x=Moles of As-fired fuel required for 100 moles of dry gas product; note: $\Sigma n_i$=100 moles of dry gas product at the Stack is the assumed calculational base; moles/base.

$x_{theor}$=Moles of As-Fired fuel associated with theoretical combustion; moles/base.

$x_{Dry\text{-}theor}$=Moles of Dry fuel associated with theoretical combustion; moles/base.

$x_{MAF\text{-}theor}$=Moles of Moisture-Ash-Free fuel associated with theoretical combustion; moles/base.

z=Moles of $H_2O$ per effluent $CaSO_4$ based on laboratory tests; molar ratio.

$\alpha_k$=As-Fired (wet-base) fuel constituent k per mole of fuel: $\Sigma\alpha_k=1.0$, where k=0,1,2, . . . 10 plus fuel CaO; see Eq.(19-corr) for terms; mole/mole-fuel.

$\alpha_{MAF-k}$=Moisture-Ash-Free fuel constituent k per mole of MAF fuel: $\Sigma\alpha_{MAF-k}=1.0$, where k=1,3,4,5,6,7,8,9; see Eq.(19-corr) for terms; mole/mole-fuel.

β=Air pre-heater dilution factor (ratio of air leakage to true combustion air); molar ratio $\beta\equiv(R_{Act}-1.0)/[a\ R_{Act}(1.0+\phi_{Act})]$ γ=Molar ratio of excess $CaCO_3$ to its stoichiometric requirements (e.g., γ=0.0 if no CaO is found in the effluent); molar ratio.

σ=Kronecker function: unity if sulfur is present in the fuel, otherwise zero; unitless.

$\phi_{Act}$=Ratio of non-oxygen gases ($N_2$ and Ar) to oxygen in the combustion air; molar ratio.

$\phi_{Act}\equiv(1.0-A_{Act})/A_{Act}$ $\phi_{Ref}$=Reference ratio of non-oxygen gases (nitrogen and argon) to oxygen in the combustion air, taken as 3.7737245; molar ratio.

Multidimensional Minimization Terms:

$F(\vec{x})$=Objective function, a functional relationship of the independent variables $\vec{x}$; unitless.

f( )=>Indicates a general functional relationship; for example, the expression:

$HHV_{k3}=f$[fuel chemistry($\vec{\Lambda}$)], means that $HHV_{k3}$ is a function of fuel chemistry (which in-turn is a function of the vector $\vec{\Lambda}$).

$C_i$=Correction factor to be applied to Choice Operating Parameter i; unitless.

$HHV_{k3}$=Higher heating value as used by the minimization techniques as a System Effect Parameter, here subscript k3 refers to either an As-Fired, Dry or MAF heating value; Btu/$lbm_{AF}$, Btu/$lbm_{Dry}$ or Btu/$lbm_{MAF}$.

$HHV_{k3-Ref}$=Higher heating value used as a Reference System Effect Parameter; here subscript k3 refers to an As-Fired, Dry or Moisture-As-Free heating value; Btu/$lbm_{AF}$, Btu/$lbm_{Dry}$ or Btu/$lbm_{MAF}$.

$J_0$=Bessel function of the first kind of order zero.

$J_1$=Bessel function of the first kind of order one.

$L_{k1}$=L Factor as used by the minimization techniques as a System Effect Parameter, subscript k1 refers to either a fuel, water or ash L Factor; note that $L'_{k1}$, $L''_{k1}$ and $L'''_{k1}$ are variations of $L_{k1}$; for $L'_{Fuel}$, units are lbm-effluent/million-$Btu_{Fuel}$.

$L_{k1-Ref}$=L Factor used as a Reference System Effect Parameter; here subscript k1 refers to either a fuel, water or ash reference L Factor; for $L'_{Fuel-Ref}$, lbm-effluent/million-$Btu_{Fuel}$.

$m_{AF}$=Fuel flow, or fuel flow rate, an As-Fired quantity (i.e., wet with water and fuel mineral matter), as computed by Input/Loss methods; also may be used by minimization techniques as a System Effect Parameter; $lbm_{AF}$/hour.

$m_{AF-PLT}$=The system's measured fuel flow, an As-Fired quantity (i.e., wet with water and fuel mineral matter), also termed the system's "indicated fuel flow"; also may be used as a Reference System Effect Parameter; $lbm_{AF}$/hour.

$M_L$=Dilution factor applied to System Effect Parameter $L_{k1}$; $M_L\geqq1.0$; unitless.

$M_W$=Dilution factor applied to System Effect Parameter $m_{AF}$; $M_W\geqq1.0$; unitless.

$M_H$=Dilution factor applied to System Effect Parameter $HHV_{k3}$; $M_H\geqq1.0$; unitless.

$S_i$=Scaling factor for the independent variable $x_i$; reciprocal units of measure of $\Lambda_i$.

$s_i$ Pre-scaling factor used to adjust $S_i$; unitless.

$\vec{x}$=Vector of independent variables, $\vec{x}=(x_1, x_2, x_3 \ldots)$, as based on scaled Choice Operating Parameters (not to be confused with the term for moles of As-fired fuel, x); unitless.

$\Lambda_i$=Choice Operating Parameter i, see the specific parameter for units of measure, and Eqs.(11S) through (17B) for definitions.

$\vec{\Lambda}$=Vector of Choice Operating Parameters, which is user selected; for example, one selection might include: $\vec{\Lambda}=(\Lambda_1S, \Lambda_{2S}, \Lambda_3, \Lambda_6, \Lambda_{7B})$; see Eqs.(11S) thru (17B).

$\Lambda_{0-i}$=Initial Choice Operating Parameter i, before application of a minimization technique, that is, the raw signal (or as otherwise determined) before correction.

$\Lambda_{F-i}$=Final Choice Operating Parameter i, after application of a minimization technique and, thus corrected, as applied in all analyses of the thermal system.

Quantities Related to System Terms:

AF=Air/Fuel ratio defined by the mass flow rate of air entering the combustion process and $m_{AF-PLT}$; unitless mass ratio.

BBTC=Energy flow to the working fluid, derived directly from the combustion process; Btu/hr.

HBC≡Firing Correction; Btu/$lbm_{AF}$.

HHVP=As-Fired higher heating value, based on $HHV_{AF}$ and used in system evaluations as corrected for a constant pressure process; Btu/$lbm_{AF}$.

*HR* = System heat rate(*HHV*- or *LHV*-based), also termed unit heat rate; Btu/kWh.

$\equiv 3412.1416/\eta_{System}$ $LHV_{k3}$=Lower heating value (also termed net calorific value), here subscript k3 refers to either an As-Fired, Dry or MAF heating value; Btu/$lbm_{AF}$, Btu/$lbm_{Dry}$, or Btu/$lbm_{MAF}$.

LHVP=As-Fired lower heating value, based on $LHV_{AF}$, and used in system evaluations as corrected for a constant pressure process; Btu/$lbm_{AF}$.

$m_{LS}$=The system's "indicated limestone flow"; lbm/hour.

$W_{output}$=Gross power generated from a power plant; kWe.

$\eta_{B-HHV}$=Boiler efficiency (HHV-based); unitless.

$\eta_{B-LHV}$=Boiler efficiency (LHV-based); unitless.

$\eta_{System}$=System thermal efficiency, corresponding to $\eta_{B-HHV}$ or $\eta_{B-HHV}$; unitless.

Subscripts and Abbreviations:

Act=Actual value determined from the operating thermal system.

AF=As-Fired fuel at the thermodynamic boundary (i.e., wet with water and mineral matter).

Dry=Dry chemical base (i.e., free of water).

MAF=Moisture-Ash-Free chemical base (i.e., free of water and free of mineral matter).

Ref=Reference value.

PLS=Pure limstone, $CaCO_3$.

theor=Refers to conditions associated with theoretical combustion.

YR & ZR=Carbon & hydrogen molecular composition of hydrocarbon fuel $\alpha_0$.

YP1 & ZP1=Carbon & hydrogen molecular composition of effluent hydrocarbon t.

YP2 & ZP2=Carbon & hydrogen molecular composition of effluent hydrocarbon u.

Meaning of Terms

As used herein, the meaning of the words "Operating Parameters" refers in general to common data obtained from a thermal system applicable to the thermodynamic understanding of that system. The following quantities are included in the definition of Operating Parameters, they are not encompassing but considered typical of a minimum set of data required for thermodynamic understanding. Effluent $CO_2$, $O_2$, and $SO_2$ concentrations are determined at the Stack, or before the air heater (Boiler side of the air pre-heater). The mass, wet-base ratio of the indicated combustion air flow at the system's fuel combustors, to the system's indicated fuel flow, termed $AF_{Act}$, should be determined. Measurements comprising the Air/Fuel ratio are required and could be made on a volume base, or a dry-base, then converted. Effluent $H_2O$ concentration measurement is required, or assumptions made (or as otherwise determined), and as dependent on Reference Fuel Characteristics. Effluent temperature measurement is required, that is the average temperature associated with the combustion gases at the system boundary (caution must be exercised in measuring non-stratified gas flows). The inlet/outlet ratio of $CO_2$ (preferred), CO, or $O_2$ across the air pre-heater (these could be obtained off-line, based on periodic testing or judgement), is used for the determination of air pre-heater leakage using the $R_{Act}$ and $\beta$ terms. Determination of fuel temperature at an appropriate system boundary is required. Air psychrometric measurements are required, or as otherwise determined, at the system boundary (e.g., dry and wet bulb temperatures, or dry bulb and relative humidity, or dry bulb and dew point temperatures). Quantities comprising the system's Firing Corrections, HBC, are required. The discharge temperatures of the air as it exits each air heating or cooling device (but before it reacts with the fuel) are required; for example, such devices might include the air pre-heater, forced-draft fan, steam-to-air heater, etc. Measurements are required to determine the total energy flow deposition to the working fluid from the combustion gases. For a power plant, such measurements typically include feedwater flow to the steam generator, feedwater pressure and temperature, determination of the steam flow from the steam generator if different than the feedwater flow, steam pressure, steam temperature or quality (or assumed quality), and, if applicable, reheat flows, and reheat inlet and outlet pressures and temperatures. For a conventional power plant, determination of accurate reheat flows generally requires understanding of steam turbine flow distributions (involving high pressure turbine shaft seals, steam flows to feedwater heaters, bypass leakages, attemperation spray flows and the like).

As used herein, the meaning of the words "Choice Operating Parameters" refers to a sub-set of Operating Parameters with additional but related terms. Choice Operating Parameters are directly applicable to this invention as parameters which may be optimized, that is the process by which errors in these parameters are reduced by application of correction factors. These parameters are chosen by the user of this invention. In the preferred embodiment, they are herein defined as the being the following seven: 1) effluent $CO_2$ concentration measured at the Stack or Boiler; 2) $H_2O$ concentration measured, or as otherwise determined, at the Stack or Boiler; 3) the mass, wet-base ratio of the indicated combustion air flow at the system's fuel combustors, to the system's indicated fuel flow, termed $AF_{Act}$; 4) the air pre-heater's leakage factor, termed $R_{Act}$; 5) the concentration of $O_2$ in the combustion air local to the system, or as otherwise determined, termed $A_{Act}$ (leading to the determination of $\phi_{Act}$); 6) the system's indicated limestone flow, termed $m_{LS}$; and 7) effluent $O_2$ concentration measured at the Stack or Boiler.

As used herein, the meaning of the words "Reference Fuel Characteristics" includes an average or typical fuel chemistry and associated MAF heating value, preferably based on historical data collections of ultimate analyses of the fuel's elementary composition (typically reported as weight fractions, leading to $\alpha_k$ molar fractions). Reference Fuel Characteristics include a MAF hydrogen versus MAF carbon relationship, that is an established functional relationship based on historical data; and in like manner MAF oxygen versus MAF carbon, MAF nitrogen versus MAF carbon, and MAF sulfur versus MAF carbon. The computed values $L_{Fuel\text{-}Ref}$, $L'_{Fuel\text{-}Ref}$, $L''_{Fuel\text{-}Ref}$, $L'''_{Fuel\text{-}Ref}$, $L_{Water\text{-}Ref}$, $L'_{Water\text{-}Ref}$, $L_{Ash\text{-}Ref}$ and $L'_{Ash\text{-}Ref}$ are included as a portion of the Reference Fuel Characteristics, computed using the reference fuel chemistry. Reference Fuel Characteristics also includes whether the variability of fuel water and fuel ash in the As-Fired condition is predictable, or not. For any given fuel: fuel water may be held constant (including zero); fuel ash may be held constant (including zero); a functionality may be observed for either or both (for example, $\alpha_{MAF\text{-}10}=f(HHV_{MAF})$; and/or fuel water and/or fuel ash may be treated as unknowns). All of these possible variations for the treatment of fuel water and fuel ash are included as a portion of the Reference Fuel Characteristics, which may influence the selection of System Options as taught herein. Reference Fuel Characteristics also contain reasonability limits of the computed elementary fuel constituents, as well as fitting constants associated with all correlations relating dependent quantities to System Effect Parameters.

As used herein, the meaning of the words "System Effect Parameters" refers to certain parameters of the thermal system and its fuel, the functionalities of System Effect Parameters impact the determination of system heat rate, as evaluated by Input/Loss methods; said functionalities dependent on at least a selection of Choice Operating Parameters. For the preferred embodiment, System Effect Parameters include the following three general types: the L Factor ($L_{k1}$); the system's As-Fired fuel flow ($m_{AF}$); and the higher heating value ($HHV_{k3}$). "Reference System Effect Parameters" are constant and targeted (i.e., desired) System Effect Parameters to which the System Effect Parameters are numerically driven by the minimization techniques through optimizing a selection of Choice Operating Parameters.

As used herein, the meaning of the words "Input/Loss methods" refers to any method or combination of methods in which one or more of the following parameters is determined based on a selection of Choice Operating Parameters, and other Operating Parameters: fuel flow, effluent flow, emission rates, fuel chemistry, fuel heating value, boiler efficiency, and/or system heat rate. In addition to these, Input/Loss methods include the methods of '470 and '420. The words "The Input/Loss Method" refers specifically to the collection of technologies described in '711, '853, '956, '527, and their related provisional patent applications and Continuation-In-Parts.

As used herein, the words "Calculational Engine" refers to a computer in which software descriptive of The Input/Loss Method is installed.

As used herein, if used, the words "obtain", "obtained", "obtaining", "determine", "determined", "determining" or "determination" are defined as measuring, calculating, computing by computer, assuming, estimating or gathering from a database. The words "establish", "established" or "establishing" are defined as measuring, calculating, computing by computer, assuming, estimating or gathering from a database.

As used herein, the words "monitoring" or "monitored" are meant to encompass both on-line monitoring (i.e., processing system data in real time) and off-line monitoring (i.e., computations involving static data).

As used herein, the meaning of the words "smoke stack" or "Stack" or "system boundary" are defined as the physical boundary of the thermal system where gaseous combustion effluents exit, entering the local environment; refer to 42 in FIG. 1, further discussed within THE DRAWINGS. Solid and liquid effluents (e.g, product ash, liquid water leakage, etc.) are referenced to the generic system's boundary 44 in FIG. 1.

As used herein, the meaning of the words "Boiler" or "Boiler Effluent" are defined as the region 35 in FIG. 1, or generically between the physical exit of the system's combustion gases region 34 in FIG. 1 and the entrance into its air pre-heater 36 in FIG. 1; further discussed within THE DRAWINGS.

Figure 2B:
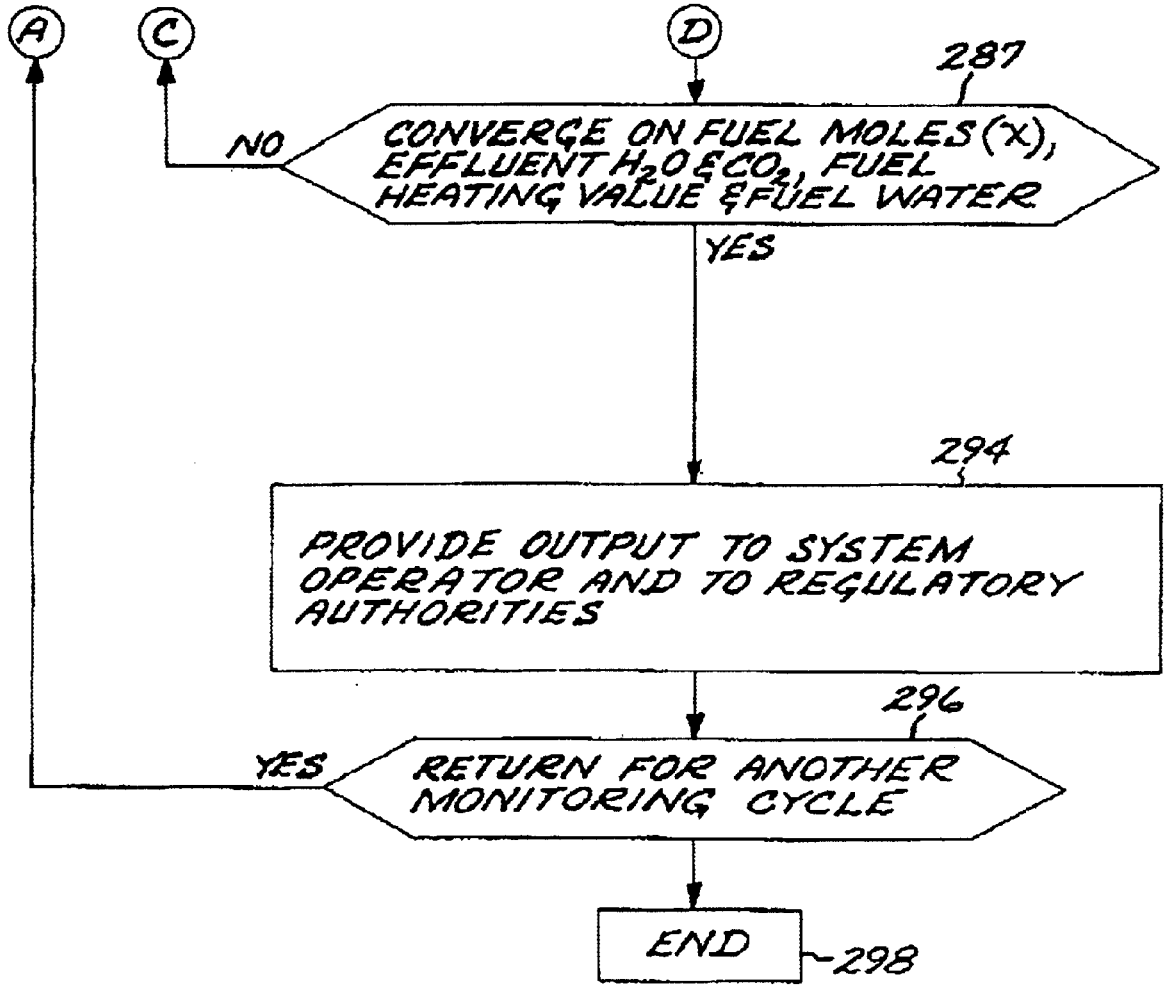

As used herein, the meaning of the words "Fuel Iterations", are defined in conjunction with a detailed description of FIG. 2, found within THE DRAWINGS.

As used herein, the meaning of the word "indicated" when used in the context of data originating from the thermal system is defined as the system's actual and uncorrected measurements of a physical process (e.g., pressure, temperature, mass flow, volumetric flow, density, and the like) whose accuracy or inaccuracy is not assumed. As examples, a system's "indicated fuel flow" or its "indicated limestone flow" denote system measurements the accuracy of which is unknown (they are "as-is", with no judgement applied). Such indicated measurements are said to be either correctable or not. If not correctable, it may be that the associated computed value, i.e., computed from Input/Loss methods, tracks the indicated value over time (the indicated not being corrected per se). In the case of indicated limestone flow when use as a. Choice Operating Parameter ($\Lambda_6$), it is directly corrected as taught by this invention. In the case of indicated fuel flow when used as a System Effect Parameter, it may be shown that the computed fuel flow, $m_{AF}$, tracks the indicated fuel flow, $m_{AF\text{-}PLT}$, through adjustment of the Dilution Factor $M_W$.

Thermodynamic Conservations and Combustion Stoichiometrics

Thermodynamic conservations consist of mass flow and energy flow conservations. Conservation of the thermal system's mass flows (i.e., inlet flows=outlet flows) using The Input/Loss Method is dependent, as taught here, on consistency of the combustion stoichiometrics, given a reasonably steady system operation. Terms comprising system mass flows, comprising a balance as seen in TABLE 1 are obtained directly from study of combustion stoichiometrics with the exception of fuel flow. Given the computed quantities $\eta_{B\text{-}HHV}$, HHVP and HBC using. The Input/Loss Method for a HHV-base calculation, and with measured BBTC energy flow, fuel flow is then derived based on the classical boiler efficiency equation. This process also is applicable for a LHV-base calculation as taught in '853 (using $\eta_{B\text{-}LHV}$, LHVP, HBC and BBTC).

Eq.(19-corr) clarifies combustion stoichiometric terms. Its nomenclature is unique in that brackets are used for clarity: for example, the expression "$\alpha_2[H_2O]$" means the fuel moles of water, algebraically simply $\alpha_2$; the expression "$d_{Acl}[CO_2]$" means the effluent moles of $CO_2$, algebraically simply $d_{Acl}$. The stoichiometric base of Eq.(19-corr) is 100 moles of dry Stack gas.

$$
\begin{aligned}
&x[\alpha_0[C_{YR}H_{ZR}]+\alpha_1[N_2]+\\
&\alpha_2[H_2O]+\alpha_{3\text{-}corr}[O_2]+\\
&\alpha_{4\text{-}corr}[C]+\alpha_5[H_2]+\alpha_6[S]+\\
&\alpha_7[CO_2]+\alpha_8[CO]+\alpha_9[H_2S]+\\
&\{\alpha_{10}-\alpha_{CaO}\}[Ash]+\\
&\alpha_{CaCO3}[CaCO_3]]_{As\text{-}Fired\ Fuel}+\\
&b_Z[H_2O]_{In\text{-}Leakage}+[(1.0+\beta)(a[O_2]+\\
&a\phi_{Acl}[N_2]+b_A[H_2O])]_{Air}+\\
&[(1.0+\gamma)b_{PLS}[CaCO_3]]_{As\text{-}Fired\ PLS}=\\
&d_{Acl}[CO_2]+g_{Acl}[O_2]+h[N_2]+\\
&j_{Acl}[H_2O]+k_{Acl}[SO_2]+[e_{Acl}[CO]+\\
&f[H_2]+l[SO_3]+\\
&m[NO]+p[N_2O]+q[NO_2]+t[C_{YP1}H_{ZP1}]+\\
&u[C_{YP2}H_{ZP2}]]_{Minor\ Componenis}+\\
&x\alpha_{10}[ash]+\sigma b_{PLS}[CaSO_4.zH_2O]+\\
&[\{(1.0-\sigma+\gamma)b_{PLS}+x\alpha_{CaCO3}\}[CaO]]_{Excess\ PLS}+\\
&v[C_{Refuse}]+[\beta(a[O_2]+a\phi_{Acl}[N_2]+\\
&b_A[H_2O])]_{Air\ Leakage}
\end{aligned}
\qquad \text{(19-corr)}
$$

This equation and its ramifications are further discussed in '711 as Eq.(29), in '853 as Eq.(19), and in '527 as Eq.(19-corr).

TABLE 1 presents the principal mass flow terms associated with a fossil-fired thermal system. As associated with a large commercial steam generator other terms may be considered using the form and teachings of TABLE 1 and its use of molar quantities developed from combustion stoichiometrics. Other representations are found in the teachings of '711, '853 and '527. As another example, a coal-fired system's rejected fuel from pulverizers represents a fuel removed before firing; its quantity could be added to both inlet and outlet flows. The fuel flow of TABLE 1, $m_{AF}$, is that fuel actually being burned, noting that rejected fuel decreases boiler efficiency (see '853) causing an increase in fuel actually burned (in addition to the system's rejection losses). If inlet and outlet mass flows disagree by more than 0.2%, errors are considered significant. Conservation of energy flows are defined and taught in '853, and are again based on combustion stoichiometrics; this is best observed in the teachings associated with Eqs.(3A), (3B) and (3C) of '853 which develop boiler efficiency.

This invention assures thermodynamic conservations. Such conservations force integration of the following quantities: boiler efficiency as taught in '853; fuel flow; useful energy flow (BBTC) leading to system heat rate as taught in '711 and '853; and computation of the L Factor as taught in '956 using consistent combustion stoichiometrics. Such integration assures the power plant engineer that consistencies of these computations are achievable.

TABLE 1

| Mass Balance of a Fossil-Fired Thermal System | |
|---|---|
| Fuel Flow Rate ($m_{AF}$) | $= BBTC/[\eta_{B\text{-}HHV}(HHVP + HBC)]$ |
| Combustion Dry Air Flow Rate | $= m_{AF}(1.0 + \beta)(a + a\,\phi_{Act})\,N_{Dry\text{-}Air}/(xN_{AF})$ |
| Combustion Air Moisture Flow Rate | $= m_{AF}(1.0 + \beta)\,b_A\,N_{H2O}/(xN_{AF})$ |
| In-Leakage of Water and Steam | $= m_{AF}\,b_z N_{H2O}/(xN_{AF})$ |
| Pure LimeStone (PLS) Injected | $= \dfrac{m_{AF}(1.0 + \gamma)b_{PLS}N_{CaCO3}/(xN_{AF})}{\sum \text{INLET MASS FLOWS}}$ |
| Dry Gas Flow as Boiler Effluent | $= m_{AF}\,100\,N_{Dry\text{-}Boiler\text{-}Gas}/(R_{Act}\,xN_{AF})$ |
| Dry Air Leakage Flow at Boundary | $= m_{AF}\,a\beta\,(1.0 + \phi_{Act})\,N_{Dry\text{-}Air}/(xN_{AF})$ |
| Combustion Moisture plus Air Leakage Moisture at Boundary | $= m_{AF}\,(j_{Act} + \beta b_A)\,N_{H2O}/(xN_{AF})$ |
| Calcium Sulfate with Water from PLS | $= m_{AF}\,\sigma b_{PLS}\,N_{CaSO4.zH2O}/(xN_{AF})$ |
| Calcium Oxide from PLS Injection and, optionally, from Fuel Carbonates | $= m_{AF}\{(1 - \sigma + \gamma)b_{PLS} + x\alpha_{CaCO3}\}NCaO/(xN_{AF})$ |
| Carbon in Ash Flow | $= m_{AF}\;\;v\,N_C/(xN_{AF})$ |
| Ash Flow (Bottom Ash, Fly Ash & Dust) | $= \dfrac{m_{AF}\alpha_{10}N_{Ash}/N_{AF}}{\sum \text{OUTLET MASS FLOWS}}$ |

This invention teaches the determination of effluent flows from the thermal system as may be required for regulatory reporting. TABLE 1 demonstrates that the dry gas flow as boiler effluent, the dry air leakage flow at the system's boundary, and/or combustion moisture plus air leakage moisture at the system's boundary may all be determined based on molar quantities, molecular weights and the computed fuel flow ($m_{AF}$).

To summarize, the following important quantities may be calculated with assurance, following '711 and '853 as enhanced by this invention, that these quantities are base on thermodynamic conservations. Fuel flow and system heat rate are determined by the following:

$$m_{AF} = BBTC/[\eta_{B-HHV}(HHVP + HBC)] \tag{63}$$

$$HR = m_{AF}(HHVP + HBC)/W_{output} \tag{64A}$$

$$= BBTC/(\eta_{B-HHV}W_{output}) \tag{64B}$$

By knowing fuel flow and fuel chemistry, and complete stoichiometric relationships as indicated by Eq.(19-corr) and as further taught in '711, calculating individual emission flows, $m_{species\text{-}i}$ (units of measure being lbm/hr), may occur as follows (which is also demonstrated in TABLE 1):

$$m_{species\text{-}i} = m_{AF}\Phi_i N_i/[xN_{AF}] \tag{65}$$

where $\Phi_i$ is the molar fraction of an effluent species on a dry-basis. The term $\Phi_i$ derives directly from determinations or measurements of the right-hand terms of Eq.(19-corr), for example $\Phi_{SO2}$=k. The emission rate per any effluent species, in typical units of measure in pounds per million Btu of fuel energy input, termed $ER_i$, is given by the following:

$$ER_i = 10^6 m_{species-i}/(m_{AF}HHVP) \tag{66}$$

$$= 10^6\Phi_i N_i/(xN_{AF}HHVP) \tag{67}$$

The emissions rate may be evaluated independently of the As-Fired fuel flow, Eq.(67). However, the computational accuracy of the fuel flow, $m_{AF}$, as determined using the present approach, intrinsically affects the emissions rate through $\Phi$, x and $N_{AF}$. Further, the process described herein allows the determination of total volumetric flow of gaseous effluent, denoted by VF, determined by the following in standard-ft$^3$/hr. When VF is based on ideal densities as taught herein, and as required for regulatory reporting, the dry and wet volumetric flows are equivalent.

$$VF = m_{AF}\rho_{Dry-Gas}N_{Dry-Gas}/(xN_{AF}) \tag{68A}$$

$$= m_{AF}\rho_{Wet-Gas}N_{Wet-Gas}/(xN_{AF}) \tag{68B}$$

By substituting for $m_{AF}$ from Eq.(63), a relationship for VF is developed independent of fuel flow:

$$VF = BBTC\rho_{Dry-Gas}N_{Dry-Gas}/[xN_{AF}\eta_{B-HHV}(HHVP + HBC)] \tag{69A}$$

$$= BBTC\rho_{Wet-Gas}N_{Wet-Gas}/[xN_{AF}\eta_{B-HHV}(HHVP + HBC)] \tag{69B}$$

Ideal densities are determined directly from stoichiometric terms of Eq.(19-corr) whose balance may be influenced by corrected Choice Operating Parameters as taught by this invention, assumed standard conditions, and molecular weights. $\rho_{Dry\text{-}Gas}$ and $\rho_{Wet\text{-}Gas}$ are given by the following:

$$\rho_{Dry-Gas} = [(100/R_{Act})N_{Dry\text{-}Boiler\text{-}Gas} + a\beta(1.0+\phi_{Act})N_{Dry\text{-}Air}]/[(100)(385.321)] \tag{70A}$$

$$\rho_{Wet-Gas} = [(100/R_{Act})N_{Dry\text{-}Boiler\text{-}Gas} + a\beta(1.0+\phi_{Act})N_{Dry\text{-}Air} + (j_{Act} + \beta b_A)N_{H2O}]/[(100)(385.321)] \tag{70B}$$

In Eqs.(70A) & (70B) the density bases is 100 moles of dry boiler gas evaluated at the Stack (requiring the $100/R_{Act}$ term), thus the stoichiometric terms a, $j_{Act}$ and $b_A$ are in per cent; and where the gas constant 10.7314 psiA-ft$^3$/lb-mole-°

R reduces with standard conditions assumed at 68° F. (527.67° R) & 14.6959 psiA to the constant 385.321 $ft^3$/lb-mole, from: (10.7314)(527.67)/14.6959. Of course, to determine the mass flow of all effluents Eq.(66) may be summed resulting in the total effluent mass flow. This invention also teaches that the above equations may produce reasonably accurate effluent volumetric flows without resort to corrected Choice Operating Parameters, when relying on reasonably estimated stoichiometric terms and molecular weights (which may be obtained from the EX-FOSS program commercially available from Exergetic Systems, Inc., San Rafael, Calif.). The quantities of system heat rate, emission flows and emission rates of the common pollutants, fuel flow, fuel heating value and/or the total volumetric flow of gaseous effluent may be required by environmental regulations to be reported.

Minimization Techniques, Background

For the preferred embodiment, four multidimensional minimization techniques are used by this invention. All techniques seek to minimize the numerical value of an objective function. These techniques include: Broyden-Fletcher-Goldfarb-Shanno (BFGS), generic Conjugate Gradient, Newton-Raphson and Simulated Annealing algorithms; references cited below. These techniques, and, notably, their combinations, are designed to address all situations of bias in Choice Operating Parameters. All of these techniques, except Simulated Annealing, employ derivatives of the objective function with respect to the independent variable. These techniques require input of initial estimates of Choice Operating Parameters ($\Lambda_{0-i}$). The BFGS, generic Conjugate Gradient and Newton-Raphson techniques employ unconstrained searches towards optima. Simulated Annealing employs a random but constrained search by which the Choice Operating Parameters are numerically bounded by lower and upper limits. From research and study conducted to develop this invention, the objective functions described below have proven to be superior for a wide variety of thermal systems.

A common problem facing minimization techniques is the so-called shallow valley problem in which an appreciable change in an independent variable has a small effect on the objective function, even through that change is both real and appropriate to the physical system. This is especially true when applied to the more important (and sensitivity) Choice Operating Parameters associated with fossil-fired systems, especially effluent $CO_2$, $H_2O$ and $O_2$. Study conducted for the development of this invention, and considered unique to it, has found that the Bessel function of the first kind is ideally suited to diminish the impact of the shallow valley problem. The Bessel function emulates the sensitivity that important Choice Operating Parameters have on both System Effect Parameters and on the descriptive thermal system in general. The Bessel function of the first kind of order zero ($J_0$) has a relatively flat (shallow) functionality as its argument approaches zero. Apart from this situation, the function offers non-linearity which is advantageous in converging out-lying arguments. Of great importance is that the derivative of $J_0$ is a Bessel function of the first kind of order one ($J_1$), having a high degree of sensitivity as its argument approaches zero. This derivative relationship addresses a significant number of shallow valley problems presented by the Choice Operating Parameters associated with thermal systems. Another technique addressing the shallow valley problem and involving use of the Bessel function is the formulation of its argument, termed either $\lambda_L$, $\lambda_W$ or $\lambda_H$ [i.e., $J_0(\lambda_L)$, $J_0(\lambda_W)$ or $J_0(\lambda_H)$]; these arguments are fully discussed below, being defined by Eqs.(2A), (2B) and (2C).

The objective function, F, is a function of independent variables $\vec{x}$; or $F(\vec{x})$. Of uniqueness to this invention, to address the inter-dependencies of the Choice Operating Parameters, $x_i$ is defined as a scaled Choice Operating Parameter ($\Lambda_i$) using the scaling factor $S_i$: $x_i \equiv S_i\Lambda_i$; further discussed above Eq.(6). By design, Choice Operating Parameters are used by Input/Loss methods to compute certain parameters reflective of the system at large. These parameters are termed System Effect Parameters and, for the preferred embodiment, include three general types and their associated reference values: the L Factor ($L_{k1}$); the As-Fired fuel flow ($m_{AF}$); and the higher heating value ($HHV_{k3}$). The higher heating value is chosen as either: an As-Fired value, $HHV_{AF}$; a Dry value, $HHV_{Dry}$; and/or a MAF value, $HHV_{MAF}$. For most situations use of the $L'_{Fuel}$ L Factor, defined by Eq.(72A-alt), is the preferred embodiment; other options are discussed below. The power plant engineer may select from any one or more or all of these System Effect Parameters (including any one or more or all of the heating values), whose differences with respect to reference values are minimized by altering the selected Choice Operating Parameters through minimization techniques. The minimization techniques are structured to minimize differences between a System Effect Parameter and its corresponding "Reference System Effect Parameter" (termed: $L_{k1\text{-}Ref}$, $m_{AF\text{-}PLT}$ and $HHV_{k3\text{-}Ref}$). System Effect Parameters are chosen such that they reflect influences on system heat rate through Choice Operating Parameters, and, at the same time, reflect inter-dependencies of the Choice Operating Parameters. For example: changes in the concentration of effluent $CO_2$ (defined as $\Lambda_{1S}$ or $\Lambda_{1B}$), affects computed fuel chemistry, thus affects computed heating value, and also affects computed boiler efficiency, all of which affect system heat rate; however a change in $CO_2$ may be caused by a change in the concentration of effluent $H_2O$ (defined as $\Lambda_{2S}$ or $\Lambda_{2B}$), or a change in the concentration of fuel ash (defined through $\Lambda_3$), whose changes themselves may also affect fuel flow and fuel chemistry. Further, all selected Choice Operating Parameters ($\vec{\Lambda}$) must be numerically scaled appropriate to the minimization technique employed.

The following summarizes the objective functionalities for the preferred embodiment, demonstrating the aforementioned principles:

$$F(\vec{x})=\Sigma_{i\epsilon I}f[S_i, J_0(\lambda_L), J_0(\lambda_W), J_0(\lambda_H)]$$

$$\lambda_L=f[L_{k1}, L_{k1\text{-}Ref}, M_L]$$

$$\lambda_W f=[m_{AF}, m_{AF\text{-}PLT}, M_W]$$

$$\lambda_H=f[HHV_{k3}, HHV_{k3\text{-}Ref}, M_H]$$

The symbol $\Sigma_{i\epsilon I}$ is defined following Eq.(3). Note that as $F(\vec{x})$ is minimized the quantities $\vec{\Lambda}$ are updated in turn ($\Lambda_i=x_i/S_i$), thus allowing System Effect Parameters to be computed leading directly to the computation of $\lambda_L$, $\lambda_W$ and $\lambda_H$. The following are functionalities of the System Effect Parameters. System Effect Parameters have general dependency on Reference Fuel Characteristics, including the following important inter-relationships: computed fuel chemistry is dependent on several or all Choice Operating Parameters, $\vec{\Lambda}$; computed heating values (HHV and HHVP) are dependent on fuel chemistry, thus $\vec{\Lambda}$; and boiler efficiency ($\eta_{B\text{-}HHV}$) determined using '853 methods is dependent directly on $\Lambda$, effluents $CO_2$ and $O_2$, is also dependent on fuel chemistry, and is also dependent on heating value, thus $\vec{\Lambda}$. Working fluid energy flow and Firing Correction terms (BBTC and HBC) are dependent on Operating Parameters.

$$x_i = S_i \Lambda_i$$

$$L_{k1} = f[\text{fuel chemistry}(\vec{\Lambda})]$$

$$m_{AF} = f[BBTC,\ \eta_{B\text{-}HHV}(\vec{\Lambda}),\ HHVP(\vec{\Lambda}),\ HBC]$$

$$HHV_{k3} = f[\text{fuel chemistry}(\vec{\Lambda})].$$

System Effect Parameters

As discussed, System Effect Parameters include three general types and their associated reference values: the L Factor ($L_{k1}$); the As-Fired fuel flow ($m_{AF}$); and the higher heating value ($HHV_{k3}$). The most important of these is the L Factor, used routinely for most situations. The higher heating value may be employed, for example, when the thermal system is operating under controlled conditions (e.g., under a testing program), in which its fuel is well characterized. Also, during initial installation of a Calculational Engine, heating value may be used for scoping the range of reasonable correction factors. Fuel flow is discussed below.

The L Factor is important in reducing the impact of the shallow valley problem found with fossil-fired systems. An important reason for this is that $L'_{Fuel}$ has been demonstrated to have remarkably small standard deviations for a given Rank of coal (typically ±0.05%). Its use as a System Effect Parameter is the preferred embodiment as $L'_{Fuel}$ computed via Eq.(72A-alt). To address the influence fuel water and fuel ash have on the L Factor, the numerator of the $L'_{Fuel}$ term contains the quantities $J_{theor}$ and ($x_{MAF\text{-}theor}\alpha_{MAF\text{-}10}N_{Ash}$), its denominator contains the As-Fired term ($x_{theor}N_{Fuel}HHV$). However, alternative approaches have been studied. For example, '711 presents the $L_{Water}$ and $L_{Ash}$ terms, and, when combined, form another System Effect Parameter ($L_{water}+L_{Ash}$) which has been found useful. Further, work leading to this invention has resulted in alternatives based on the observation that the denominator and numerator forming $L'_{Fuel}$, may themselves be constant for certain fuels; these are termed $L'_{Water}$ and $L'_{Ash}$. These various forms of the L Factors ($L_{k1}$) are defined by the following relationships.

$$L_{Fuel} = 10^6[100N_{Dry\text{-}Gas}]/(N_{Dry\text{-}Fuel}HHV_{Dry}) \quad (71)$$

$$L'_{Fuel} = 10^6[x_{Dry\text{-}theor}N_{Dry\text{-}Fuel} + a_{Dry\text{-}theor}(1.0+\phi_{Ref})N_{Air} - J_{theor}N_{H2O} - x_{MAF\text{-}theor}\alpha_{MAF\text{-}10}N_{Ash} - x_{MAF\text{-}theor}\alpha_{MAF\text{-}7}N_{CO2}]/(x_{theor}N_{Fuel}HHV) \quad (72A\text{-alt})$$

$$L_{Water} = 10^6 J_{theor}N_{H2O}/(x_{Dry\text{-}theor}N_{Dry\text{-}Fuel}HHV_{Dry}) \quad (73\text{-altA})$$

$$L'_{Water} = [x_{Dry\text{-}theor}N_{Dry\text{-}Fuel} + a_{Dry\text{-}theor}(1.0+\phi_{Ref})N_{Air} - J_{theor}N_{H2O} - x_{MAF\text{-}theor}\alpha_{MAF\text{-}10}N_{Ash} - x_{MAF\text{-}theor}\alpha_{MAF\text{-}7}N_{CO2}] \quad (73\text{-altB})$$

$$L_{Ash} = 10^6[x_{MAF\text{-}theor}\alpha_{MAF\text{-}10}N_{Ash} + x_{MAF\text{-}theor}\alpha_{MAF\text{-}7}N_{CO2}]/(x_{Dry\text{-}theor}N_{Dry\text{-}Fuel}HHV_{Dry}) \quad (74\text{altA})$$

$$L'_{Ash} = 10^6 x_{theor}N_{Fuel}HHV \quad (74\text{-altB})$$

where the identity: $x_{MAF\text{-}theor}N_{MAF\text{-}Fuel}HHV_{MAF} = x_{Dry\text{-}theor}N_{Dry\text{-}Fuel}HHV_{Dry} = xtheor N_{Fuel}HHV$ has been found useful in developing L Factors. The System Effect Parameters $L'_{Water}$, $L_{Water}$ and the combined ($L_{Water}+L_{Ash}$), although all are a function of $\vec{\Lambda}$ through fuel chemistry, are intended to be used to optimize only the Choice Operating Parameter for effluent water ($\Lambda_{2S}$ or $\Lambda_{2B}$) as it effects fuel water. The System Effect Parameters $L'_{Ash}$, $L_{Ash}$ and the combined ($L_{Water}+L_{Ash}$), although all are a function of $\vec{\Lambda}$ through fuel chemistry, are intended to be used to optimize only the Choice Operating Parameter for the air/fuel ratio ($\Lambda_3$) as such ratio effects fuel ash. These System Effect Parameters are unique in that they are designed for selective use, illustrating that System Effect Parameters may be formed specific to a selected Choice Operating Parameter, provided that the overall process reflects the influence on heat rate of the Choice Operating Parameters selected, $\vec{\Lambda}$. Their use has proved valuable for fuels having low or predictable fuel water and fuel ash contents. However, the universal L Factor, $L'_{Fuel}$, as the preferred embodiment, has proven highly successful for optimizing all Choice Operating Parameters ($\vec{\Lambda}$), including fuel water and fuel ash.

A further alternative to the above computation of L Factors is to form a correlation as a function of a Choice Operating Parameter or other Operating Parameters. For example, the following correlation relates the L Factor for fuel, termed $L''_{Fuel}$, to $\Lambda_{1S}$, the Stack effluent $CO_2$ ($d_{Act}$), where the quantities $K_{11}$, $K_{12}$ and $K_{13}$ are correlation constants.

$$L''_{Fuel} = K_{11} + K_{12}d_{Act} + K_{13}(d_{Act})^2 \quad (75)$$

A further alternative, applicable to situations in which the computed $L'_{Fuel}$ of Eq.(72A-alt) is found not to be constant, but is correctable (producing a constant value) based on study of Reference Fuel Characteristics; if so correctable, termed $L'''_{Fuel}$. For such situations, corrections may be applied to the results of Eq.(72A-alt). For example, if the $\alpha_{MAF\text{-}7}$ term of Eq.(72A-alt) is set to zero (given a lack of data), but $L'_{Fuel}$ is determined to be non-constant but predictable, a correction as a function of $\alpha_{MAF\text{-}C}$ (also termed $\alpha_{MAF\text{-}4}$) may be developed as follows, the quantities $K_{21}$, $K_{22}$ and $K_{23}$ being correlation constants. Thus Eq.(76) may produce constant $L'''_{Fuel}$ values.

$$L'''_{Fuel} = L'_{Fuel} + K_{21} + K_{22}N_{O2}\alpha_{MAF\text{-}C} + K_{23}(N_{O2}\alpha_{MAF\text{-}C})^2 \quad (76)$$

A variation of this form, found useful for systems burning coals which have $CO_2$ producing mineral matter such as found with Powder River Basin coals and certain lignites is given by the following:

$$L'''_{Fuel} = L'_{Fuel} + K_{32}N_{O2}(\alpha_{MAF/Ref\text{-}O} - \alpha_{MAF\text{-}O}) \quad (77)$$

The term $\alpha_{MAF\text{-}O}$ is the MAF molar fraction of fuel oxygen (also termed $\alpha_{MAF\text{-}3}$); its reference quantity, $\alpha_{MAF/Ref\text{-}O}$, and the correlation constant $K_{32}$ being based on a reference fuel chemistry. For coals which have $CO_2$ producing mineral matter, Eq.(77) is the preferred embodiment; where the constants $K_{32}$ and $\alpha_{MAF/Ref\text{-}O}$ are determined based on average values established as a portion of Reference Fuel Characteristics; $L'_{Fuel}$ being determined from Eq.(72A-alt). An example of such a fuel is presented in FIG. 4, obtained from a power plant burning Powder River Basin coal. One feature of The Input/Loss Method as taught in '711, is to form correlations among MAF fuel constituents; of most import, the correlation between hydrogen and carbon; for example: $\alpha_{MAF\text{-}H} = A_5 + B_5\alpha_{MAF\text{-}C}$. If it has been determined that a system's fuel contains $CO_2$ producing mineral matter, then the preferred embodiment is to determine a computed relationship between $\alpha_{MAF\text{-}O}$ and $\alpha_{MAF\text{-}C}$ which satisfies Eq.(72A-alt), Eq.(77) and the $\alpha_{MAF}H = f(\alpha_{MAF\text{-}C})$ functionality; thus a computed relationship which recognizes and corrects the impact on the $L'_{Fuel}$ quantity of $CO_2$ production from mineral matter. This is accomplished using the following steps: substitute Eq.(72A-alt), or Eq.(71), into Eq.(77) for $L'_{Fuel}$; within the result substitute with $\alpha_{MAF-C}$ wherever possible; recognize molar dependencies on $N_{MAF-Fuel}$ and $HHV_{MAF}$ of the $\alpha_{MAF-O}$ & $\alpha_{MAF-C}$ terms, and similar dependencies; and then, by varying $\alpha_{MAF-C}$, determine $\alpha_{MAF-O}=f(\alpha_{MAF-C})$ which will then satisfy both Eq.(77) and the computation of the L Factor. Such a relationship, for example Eq.(78) where $A_3$ & $B_3$ are correlation constants, may then be used throughout Input/Loss methods in combination with Eq.(77).

$$\alpha_{MAF-O}=A_3+B_3\alpha_{MAF-C} \tag{78}$$

Along with the L Factor, the power plant engineer may also choose, in any combination, the plant's indicated fuel flow, the As-Fired heating value, the Dry heating value and/or the MAF heating value as System Effect Parameters. Although the power plant engineer has complete flexibility, with this flexibility must apply common engineering judgement. For example, optimizing effluent water against $HHV_{MAF}$ or $HHV_{Dry}$ (heating values without water) would make little sense given the lack of connectivity.

Selecting the system's indicated fuel flow, $m_{AF-PLT}$, as a Reference System Effect Parameter is at odds with '470 and '420 and the teachings of '711, since inaccuracies in a measured flow of a bulk fuel, such as coal, may be appreciable. However, in developing this invention, observations at several power plants revealed that coal flow measurements may be consistent, but not necessarily accurate, reflecting changes in any number of quantities which may impact system heat rate. As such, this invention teaches that the minimization techniques may be used to minimize the difference between a computed fuel flow ($m_{AF}$ of Eq.(63) & TABLE 1) and the system's indicated fuel flow, $m_{AF-PLT}$, through optimized Choice Operating Parameters. Thus, the method of this invention allows use of the system's indicated fuel flow to aid in the determination of computed fuel chemistry and fuel heating value. Although not required, for many situations it is the preferred embodiment that use of the system's indicated fuel flow be accompanied with the $L'_{Fuel}$ factor of Eq.(72A-alt), to assist with stability and reasonableness of solution. To further enhance stability and reasonableness of solution the power plant engineer may option to limit the range of fuel concentrations determined by the methods of this invention. The engineer may also limit the numerical range of each selected Choice Operating Parameter when using Simulated Annealing. Further, to address the likelihood that $m_{AF-PLT}$ is in error, a Dilution Factor ($M_W$) has been applied to the relationship between $m_{AF}$ and $m_{AF-PLT}$; see Eq.(2B) as discussed below.

In summary, the process involving the minimization of differences in System Effect Parameters, by optimizing Choice Operating Parameters, results in correcting Choice Operating Parameters with the correction factor, $C_i$. These correction factors are based on the ratio of the converged Choice Operating Parameter ($\Lambda_{F-i}$), to its initial estimate ($\Lambda_{0-i}$). $\Lambda_{0-i}$ are typically based on the system's raw instrumentation signal or as otherwise determined.

$$C_i=\Lambda_{F-i}/\Lambda_{0-i} \tag{1}$$

Minimization Techniques, Formulations

This sub-section presents general discussions of the multidimensional minimization techniques and details formulations useful to the power plant engineer in minimizing errors in System Effect Parameters.

The BFGS technique represents a second generation of multidimensional minimization techniques. As such, it is considered one of the most robust of techniques for a well conditioned problem. The particular BFGS technique employed by the Calculational Engine has a superior reputation for convergence. The only input parameters the user need be concerned with are the initial relative step-length and the change in the relative step-length. A well-chosen initial relative step-length will prevent long iterations (a value of 0.100 to 0.200 is recommended). The change in the relative step-length impacts resolution of the shallow valley problem, and may be varied until proper convergence patterns are established. A value between 0.010 to 0.040 for the change in the relative step-length has been found to be satisfactory when used in conjunction with the scaling techniques taught herein. The BFGS technique is the preferred method for use on a continuous bases after the problem has been properly conditioned with scaling factors, and selections of Choice Operating and System Effect Parameters have been established. These input parameters are also applicable to the generic Conjugate Gradient technique.

The generic Conjugate Gradient technique represents a first generation of multidimensional minimization techniques. For numerical processing reasons the BFGS technique has been demonstrated to be superior in to the generic Conjugate Gradient in convergence techniques and accuracy. However, there may be situations in which a generic Conjugate Gradient may be useful as an alternative once the problem has been conditioned.

The Newton-Raphson method is one of the oldest and simplest multidimensional minimization techniques. This method requires the objective function's compounded vector gradient, resulting in a Jacobian determinant. Generally it will yield an efficient means of convergence but requires reasonable initial Choice Operating Parameters ($\Lambda_{0-i}$); however, without such reasonableness it may fail wildly. Newton-Raphson is recommended for use only after the BFGS technique has failed to meet its convergence criteria. It has applicability given its use of the Jacobian determinant, through which forming explicit inter-dependencies between System Effect Parameters and all Choice Operating Parameters are employed. This assures computed dependencies, if such dependencies exist. This intrinsic feature has been found to be of importance when resolving certain power plant problems. The preferred embodiment is to automatically default from BFGS, given failure to meet its convergence (typically due to a lack of established interdependencies of Choice Operating Parameters) to, first, the Newton-Raphson, and then in-turn, given its failure, to Simulated Annealing. Newton-Raphson may also be used for scoping initial installations of Input/Loss methods given difficult combinations of System Effect and Choice Operating Parameters.

The Simulated Annealing procedure, because it employs a global, constrained methodology, is the preferred embodiment for initial study of a new Input/Loss installation. It may also be used to assist in the selection of which Choice Operating Parameters are best for a particular thermal system. This procedure simulates the annealing process of metal, requiring the controlled reduction of a pseudo-temperature (herein termed "pseudo-T") to achieve a desired result (i.e., achieving a minimum potential energy of the metal's structure when slowly cooled, thus the minimizing of an objective function). This is a brute force approach involving random search; gradients are not used. As a global optimization procedure it may move both downhill and uphill (that is, it may move both towards and away from local optima), resulting in distinction between different local optima Conventional optimization techniques (BFGS, generic Conjugate Gradient and Newton-Raphson) only move downhill when minimizing an objective function. Conventional techniques are blind to a global solution in the sense they immediately choose the downhill direction. When addressing fossil-fired combustion problems this may lead to optimizing on the most sensitive of a given selection of Choice Operating Parameters (most likely $CO_2$, thus $\Lambda_{1S}$ or $\Lambda_{1B}$). Distinction between different local optima is accomplished by first starting with initial $\Lambda_{0-i}$ values, then successively evaluating randomly acquired changes, $\vec{\Lambda}$, but which fall within user-defined step-lengths. Initially this results in a coarse study of the objective function, employing large step-lengths, requiring repeated evaluations with seemingly little progress. In the process of choosing $\vec{\Lambda}$ values the algorithm generally attempts to move downhill, however it also moves uphill in a probabilistic manner to escape local optima Step-lengths are dynamically chosen such that half of all uphill moves are randomly accepted, helping to ensure that the function escapes local optima. As the annealing process proceeds and the algorithm closes on the global optimum, step-lengths decrease as the pseudo-T decreases requiring even more objective function evaluations as the optimum is approached. By viewing objective functions in general terms and with its ability to move probabilistically uphill, Simulated Annealing solves functions that are otherwise difficult to resolve, including shallow valley problems associated with fossil-fired combustion. However, with such flexibility comes numerous objective function evaluations necessitating long computing times. In addition, converged solutions should be re-tested periodically with different seeds (i.e., initializations of the random number generator) to assure the global optimum.

When applied to fossil-fired combustion, the more sensitive inputs to the Simulated Annealing algorithm include the following: starting point $\zeta_{0-i}$ values; the number of cycle evaluations (5 is recommended); the minimum and maximum values associated with each $\Lambda_i$ (i.e., defining the region containing the optimum); an initial pseudo-T (0.100 is recommended); and the relative change in pseudo-T (i.e., the step-length, 0.010 to 0.020 is recommended). Each of these inputs may be established by sensitivity study to assure a robust solution, or as otherwise determined. Minimum and maximum $\Lambda_i$ values may also be established by review of historical system data or through the experience of the power plant engineer. The smaller the range between minimum and maximum $\Lambda_i$ values, the tighter the search becomes with the final solution becoming narrowed. This feature is especially useful when indicated fuel flow is selected as a System Effect Parameter (in combination with a non-unity Dilution Factor, $M_W$).

The following paragraphs present the preferred objective functions and their solution methodologies, and specify the Choice Operating Parameters employed by the four minimization techniques. As explained, the Bessel function is used to define the objective function. The Bessel function's argument, as taught by this invention, has been chosen to aid in addressing the shallow valley problem and in convergence of the minimization techniques. The formulations presented produce quantities which may allow numerical inter-dependencies between Choice Operating Parameters ($\vec{\Lambda}$), or not, depending on the Method Option chosen. This is important for addressing problems in which initial values of Choice Operating Parameters lie far from the optimum. This is also important where more than one System Effect Parameter is chosen which may present unique numerical convergence problems.

For the BFGS, generic Conjugate Gradient, Newton-Raphson and Simulated Annealing techniques the objective function is given by the following. Note that $M_L$, $M_W$, and $M_H$ are real numbers, greater than or equal to one. Again, the System Effect Parameters, $L_{k1}$, $m_{AF}$ and $HHV_{k3}$, are functions of a set of $\Lambda_i$.

$$\lambda_L=[(L_{k1}-L_{k1\text{-}Ref})/L_{k1\text{-}Ref}]^{M_L} \tag{2A}$$

$$\lambda_W=[(m_{AF}-m_{AF\text{-}PLT})/m_{AF\text{-}PLT}]^{M_W} \tag{2B}$$

$$\lambda_H=[(HHV_{k3}-HHV_{k3\text{-}Ref})/HHV_{k3\text{-}Ref}]^{M_H} \tag{2C}$$

$$F(\vec{x})=\Sigma_{i\epsilon I}\{S_i[1.0-J_0(\lambda_L)]+Si[1.0-J_0(\lambda_W)]+S_i[1.0-J_0(\lambda_H)]\} \tag{3}$$

In Eq.(3) and as used elsewhere, the symbol $\Sigma_{i\epsilon I}$ indicates a summation on the index i, where i variables are contained in the set I defined as the elements of $\vec{\Lambda}$. For example, assume the user has chosen the following: $\Lambda_{1S}$ is to be optimized to minimize the error in $L'_{Fuel}$ and $HHV_{MAF}$, $\Lambda_{2S}$ is optimized for $L'_{Fuel}$ and $m_{AF}(M_W=1.40)$, $\Lambda_4$ is optimized for $L'_{Fuel}$, and $\Lambda_{7B}$ is optimized for $L'_{Fuel}$. Therefore: $\vec{\Lambda}=(\Lambda_{1S}, \Lambda_{2S}, \Lambda_4, \Lambda_{7B})$, $I=\{\Lambda_{1S}, \Lambda_{2S}, \Lambda_4, \Lambda_{7B}\}$, thus $\vec{x}=(x_1, x_2, x_3, x_4)$; $x_1=S_1\Lambda_{S1}$; $x_2=S_2\Lambda_{2S}$; $x_3=S_3\Lambda_4$; $x_4=S_4\Lambda_{7B}$; where Eq.(3) for this example then becomes:

$$F(\vec{x})=S_1\{[1.0-J_0(\lambda_L)]+[1.0-J_0(\lambda_H)]\}+S_2\{[1.0-J_0(\lambda_L)]+[1.0-J_0(\lambda_W)]\}+S_3[1.0-J_0(\lambda_L)]+S_4[1.0-J_0(\lambda_L)]$$

Derivatives $\partial F/\partial x_i$ for the BFGS and generic Conjugate Gradient techniques, based on Eq.(3), are given by the following:

$$\begin{aligned}\frac{\partial F}{\partial x_i} &= \frac{\partial F}{(S_i\partial\Lambda_i)} \\ &= S_iJ_1(\lambda_L)\left[\frac{\partial\lambda_L}{(S_i\partial\Lambda_i)}\right]+S_iJ_i(\lambda_W)\left[\frac{\partial\lambda_W}{(S_i\partial\Lambda_i)}\right]+S_iJ_i(\lambda_H)\left[\frac{\partial\lambda_H}{(S_i\partial\Lambda_i)}\right] \\ &= J_1(\lambda_L)\left[\frac{\partial\lambda_L}{\partial\Lambda_i}\right]+J_1(\lambda_W)\left[\frac{\partial\lambda_W}{\partial\Lambda_i}\right]+J_1(\lambda_H)\left[\frac{\partial\lambda_H}{\partial\Lambda_i}\right]\end{aligned} \tag{4}$$

where, for example: $[\partial\lambda_W/\partial\Lambda_i]=M_W[(\overline{m}_{AF}-m_{AF\text{-}PLT})/m_{AF\text{-}PLT}]^{M_W-1}[\partial m_{AF}/(m_{AF\text{-}PLT}\partial\lambda_i)]$; and $\overline{\lambda}_L$, $\overline{\lambda}_W$, $\overline{\lambda}_H$ and $\overline{m}_{AF}$ are average values. Gradients, $\partial F_i/\partial x_j$, for the Newton-Raphson method, thus defining the Jacobian determinant, are given by the following:

$$\begin{aligned}\frac{\partial F_i}{\partial x_j} &= \frac{\partial F_i}{(S_j\partial\Lambda_j)} \\ &= S_iJ_1(\lambda_L)\left[\frac{\partial\lambda_L}{(S_j\partial\Lambda_j)}\right]+S_iJ_1(\lambda_W)\left[\frac{\partial\lambda_W}{(S_j\partial\Lambda_j)}\right]+S_iJ_1(\lambda_H)\left[\frac{\partial\lambda_H}{(S_j\partial\Lambda_j)}\right]\end{aligned} \tag{5}$$

where, for example: $[\partial\lambda_W/\partial\Lambda_j]=M_W[(\overline{m}_{AF}-m_{AF\text{-}PLT})/m_{AF\text{-}PLT}]^{M_W-1}[\partial m_{AF}/(m_{AF\text{-}PLT}\partial\Lambda_j)]$.

In the preferred embodiment, Choice Operating Parameters may be chosen by the power plant engineer from any combination or all of the following:

$\Lambda_{1S}=d_{Aci}$; Stack $CO_2$ (with effects from Air Pre-Heater leakage) (11S)

$\Lambda_{1B}=d_{Aci}R_{Aci}$; Boiler $CO_2$ (without effects from Air Pre-Heater leakage) (11B)

$\Lambda_{2S}=J_{Aci}=j_{Aci}+b_A\beta$; Stack $H_2O$ (with $H_2O$ from Air Pre-Heater leakage) (12S)

$\Lambda_{2B}=j_{Aci}R_{Aci}$; Boiler $H_2O$ (without $H_2O$ from Air Pre-Heater leakage) (12B)

$\Lambda_3 = AF$; *Air/Fuel ratio* (13)

$\Lambda_4 = R_{Act}$; Air Pre-Heater leakage factor (14)

$\Lambda_5 = A_{Act}$; Concentration of $O_2$ in the combustion air (15)

$\Lambda_6 = m_{LS}$; System's indicated limestone flow (16)

$\Lambda_{7S} = G_{Act} \equiv g_{Act} + a\beta$; Stack $O_2$ (with Air Pre-Heater leakage) (17S)

$\Lambda_{7B} = g_{Act} R_{Act}$; Boiler $O_2$ (without Air Pre-Heater leakage) (17B)

The selection of one or more of the Choice Operating Parameters must depend on common understanding of power plant stoichiometrics and associated relationships to physical equipment. What the ERR-CALC program produces, employing one or more of the minimization techniques, are correction factors, determined via Eq.(1), for each chosen $\Lambda_i$ which are then applied to the raw uncorrected signal ($\Lambda_{0-i}$). The resulting corrected signal is then processed within the Fuel Iterations, defined in conjunction with a detailed description of FIG. 2. Fuel Iterations are processed as frequently as desired, with revised correction factors from ERR-CALC produced at the same or slower frequency. For example, ERR-CALC could be processed (producing correction factors) once per day, while Fuel Iterations are being processed once every 3 minutes.

In the above paragraph, the phase "common understanding of power plant stoichiometrics and associated relationships to physical equipment" is meant the routine knowledge base a power plant engineer should have concerning his/her thermal system. To thoroughly teach this invention, examples of such common understanding and their associated impacts on this invention follow: if limestone ($\Lambda_6$) is not used, the power plant engineer would not select limestone as a Choice Operating Parameter as such a selection would result in an unity correction factor, non-convergence, warning messages and thus a faulted condition produced from ERR-CALC; the selection of the air pre-heater leakage factor ($\Lambda_4$) would not be made if the system uses a tubular exchanger which has no air leakage (as designed), and would result in a similar faulted condition; the selection of the air/fuel ratio ($\Lambda_3$) leading to determination of fuel ash, and also invoking a constant fuel ash assumption (System Option S3), would not be made as such a selection would result in a similar faulted condition; the selection of Boiler $CO_2$ ($\Lambda_{1B}$), an air pre-heater leakage factor ($\Lambda_4$), and Boiler $O_2$ ($\Lambda_{7B}$), given that "correcting" the air pre-heater leakage would have no effect on the Boiler-side mix of $CO_2$ and $O_2$, would result in a similar faulted condition.

The use of the exponents $M_L$, $M_W$ and $M_H$ in Eqs.(2A), (2B) & (2C), termed Dilution Factors, allows a dilution or dampening of the functionality between Reference System Effect Parameters ($L_{k1\text{-}Ref}$, $m_{AF\text{-}PLT}$ and $HHV_{k3\text{-}Ref}$) and selected Choice Operating Parameters ($\vec{\Lambda}$). As an important feature of this invention, Dilution Factors allow the numerical processes to recognize that Reference System Effect Parameters may themselves have bias. Examples of such bias include: Reference Fuel Characteristics having been chosen with an out-dated database, biasing the computed reference L Factor; the reference heating value having been determined incorrectly, analyzed incorrectly in the laboratory and/or having intrinsic uncertainties; and the indicated fuel flow having serious instrumentation error. Although engineering judgement and a valid database may be reasonably anticipated and applied in the cases of reference L Factors and reference heating values, such judgement and a valid database are rare in the case of the plant's indicated fuel flow. Dilution Factors $M_L$ (influencing $L_{k1\text{-}Ref}$) and $M_H$ (influencing $HHV_{k3\text{-}Ref}$) may be assumed to be unity for most situations which is preferred; or they may be based on monitoring experience, sensitivity studies or as otherwise determined. However, for coal-fired plants, it is likely that indicated fuel flow will always have bias; thus $M_W$ (influencing $m_{AF\text{-}PLT}$) should be determined based on results from Input/Loss methods and the processes of this invention, when such results are generically compared to system data. Specifically, $M_W$ may be adjusted until Input/Loss computed total effluent flow reasonably agrees and/or tracks the measured, computed combustion air flow agrees and/or tracks the measured, computed fuel flow agrees and/or tracks the indicated fuel flow, and similar system-wide comparisons. In the context of the last sentence, "tracks" is defined as the computed value trending over time with the measured, having a constant off-set. Further, application of Dilution Factors require that the sense of the bracketed terms of Eqs.(2A), (2B) and (2C) be always positive (given $M_L$, $M_W$ and $M_H$ are real numbers and $\geqq 1.00$), requiring a reversal of the derivative's sign as appropriate.

Note that a standardized $A_{Act}$ term, the concentration of $O_2$ in the combustion air local to and entering the system, has been defined by the Nation Aeronautics and Space Administration (NASA) at sea level as 20.9480%. However, as employed herein, the value of $A_{Act}$ (as Choice Operating Parameter $\Lambda_5$) may be influenced by: altitude of the system; local atmospheric inversions or other weather patterns which may result in starving the local environment for oxygen given a consumption by combustion and not being filly replenished; and/or combustion gases leaking directly into the combustion air stream. $A_{Act}$ leads directly to a determination of the $\phi_{Act}$ term appearing in all combustion equations. In common text books $\phi_{Act}$ is assumed to be constant at 3.76; if using the NASA standard $\phi_{Act}$ is 3.7737254. In the present invention $\phi_{Act}$ is expressed as a variable, dependent on $A_{Act}$, to be determined by the power plant engineer based on circumstances local to the thermal system.

To address the inter-dependencies of Choice Operating Parameters, and of significance to this invention, is that The Input/Loss Method combustion stoichiometrics incorporate the $R_{Act}$ term (Choice Operating Parameter $\Lambda_4$), and the $A_{Act}$ term. Specifically, The Input/Loss Method combustion stoichiometrics should also incorporate the $\phi_{Act}$ term as derived solely from $A_{Act}$, and should incorporate the $\beta$ term derived from $\phi_{Act}$ and $R_{Act}$. Air pre-heater leakage dilutes all exiting combustion effluents with moist air from the local environment. Therefore all important effluents, $CO_2$, $H_2O$ and $O_2$, used for this invention are thus effected and have inter-dependencies. Many times a power plant's more precise effluent measurements, especially $O_2$, may be found at the air pre-heater's inlet (economizer outlet or Boiler), and not at the air heater outlet; thus requiring the use of the $R_{Act}$ term. Although most environmental regulations require effluent measurements at the system's boundary, translation between the air heater inlet and outlet measurements is many times essential. The $R_{Act}$ term allows for such translation and thus establishes inter-dependencies among Choice Operating Parameters. Effluents comprising Choice Operating Parameters may be used by the present invention either upstream or downstream of the air pre-heater, and in any mix. Effluent measurements upstream of the air pre-heater (Boiler) would employ terms, for example, of $d_{Act}R_{Act}$, $j_{Act}R_{Act}$, and $g_{Act}R_{Act}$. Effluents downstream of the air pre-heater, typically at the exit of the system (Stack), would employ terms $d_{Act}$, $J_{Act}$ and $G_{Act}$ (see Choice Operating Parameters $\Lambda_{1S}$, $\Lambda_{2S}$, and $\Lambda_{7S}$). $R_{Act}$ allows for such mix of effluent measurements and thus establishes inter-dependencies. Sorbent injection into the combustion process, such as limestone (Choice Operating Parameter $\Lambda_6$) as used to control sulfur emissions, may create additional effluent $CO_2$, and/or could decrease the effluent $H_2O$ if the sulfate product is matrixed with water, $CaSO_4.zH_2O$. In summary, use of these terms address four features which specifically force inter-dependency of the Choice Operating Parameters: 1) the ability to address air pre-heater leakage through application of the leakage factor $R_{Act}$ and the $\phi_{Act}$ term used to determine the air pre-heater dilution factor, $\beta$; 2) the ability to describe effluent concentrations on either side of the air pre-heater in any mix, through application of $R_{Act}$; 3) the ability to address injected sorbents, such as limestone which effects effluent $CO_2$, commonly used in fluidized bed combustors; and 4) the use of a variable $\phi_{Act}$ term based on variable $O_2$ concentration in the system's local combustion air ($A_{Act}$).

In these relationships each Choice Operating Parameter ($\Lambda_i$) is scaled with the parameter $S_i$, determined to be suitable for the BFGS, generic Conjugate Gradient and Newton-Raphson techniques. Scaling for these methods is important for proper application of this invention, as minimization techniques in general are sensitive to variations in the numerical size, and units of measure, of the $\Lambda_i$ terms (e.g., for power plant applications, an un-scaled $\Lambda_{1S}$ may be 0.14 moles-$CO_2$/mole-Dry-Stack-Gas, while an un-scaled $\Lambda_6$ may be 22,000 lbm/hr). It has been found that a good initial estimate of $S_i$ may be developed as the inverse of $\Lambda_i$. Further, the influence of scaling may be improved by employing a pre-scaling factor, $s_i$; which may be determined as explained below, or as otherwise determined by the power plant engineer through sensitivity studies.

$$S_i \equiv s_i/\Lambda_{0\text{-}i} \tag{6}$$

$$x_i \equiv S_i \Lambda_i \tag{7}$$

Although BFGS, generic Conjugate Gradient, and Newton-Raphson techniques are a sensitive to scaling of independent variables, Simulated Annealing does not require scaling. This invention teaches to use this Simulated Annealing feature to define the pre-scaling factor $s_i$, which may then be used by BFGS, generic Conjugate Gradient, and Newton-Raphson. Simulated Annealing is used to analyze a problem, setting $S_i = s_i = 1.00$ upon initialization. After convergence, $s_i$ is then defined as the ratio of the optimized (final) Choice Operating Parameter (termed $\Lambda_{F\text{-}i}$) and the smallest of these (termed $\Lambda_{F\text{-}min}$). $S_i$ is then based on the ratio of this normalized $s_i$ and the final optimized Choice Operating Parameter, being the inverse of $\Lambda_{F\text{-}min}$:

$$s_i = \Lambda_{F-i}/\Lambda_{F-\min} \tag{8}$$

$$S_i = s_i/\Lambda_{F-i} \tag{9}$$

$$= 1.0/\Lambda_{F-\min} \tag{10}$$

Applicable references for the preferred minimization techniques include the following sources. For the BFGS and the generic Conjugate Gradient techniques the references are: D. F. Shanno and K. H. Phua, "Algorithm 500, Minimization of Unconstrained Multivariate Functions", *ACM Transactions on Mathematical Software*, Vol.2, No.1, March 1976, pages 87–94; and D. F. Shanno and K. H. Phua, "Remark on Algorithm 500, Minimization of Unconstrained Multivariate Functions", *ACM Transactions on Mathematical Software*, Vol.6, No.2, December 1980, pages 618–622. For the Simulating Annealing technique the references are: W. L. Goffe, G. D. Ferrier and J. Rogers, "Global Optimization of Statistical Functions with Simulated Annealing", *Journal of Econometrics*, Vol.60, No.1/2, pp.65–100, January/February 1994; for its base technology see: A. Corana, M. Marchesi, C. Martin and S. Ridella, "Minimizing Multimodal Functions of Continuous Variables with the 'Simulated Annealing' Algorithm", *ACM Transactions on Mathematical Software*, Vol.13, No.3, pp.262–280, September 1987; for modifications to the random number generator RANMAR which is employed by Simulating Annealing see: F. James, "A Review of Pseudorandom Number Generators", *Computer Physics Communications*, Vol.60, pp.329–344, 1990. For the Newton-Raphson technique the reference is: W. H. Press, S. A. Teukolsky, W. T. Vettering & B. P. Flannery, *Numerical Recipes in FORTRAN 77, The Art of Scientific Computing*, Cambridge University Press, Cambridge and New York (1992), Chapter 9.6 on Newton-Raphson Method for Nonlinear Systems of Equations, and Chapter 9.7 on Globally Convergent Methods for Nonlinear Systems of Equations.

Additional minimization techniques and teachings of related mathematical procedures which may be applied to this invention, are presented in the following: J. Nocedal and S. J. Wright, *Numerical Optimization*, Springer-Verlag, New York (1999); G. N. Vanderplaats, *Numerical Optimization Techniques for Engineering Design*, McGraw-Hill Book Company, New York (1984); and W. H. Press, S. A. Teukolsky, W. T. Vettering & B. P. Flannery, *Numerical Recipes in FORTRAN 77, The Art of Scientific Computing*, Cambridge University Press, Cambridge and New York (1992). Other common minimization techniques involving constrained or unconstrained searches may also be alternatively applied. These include Sequential Linear Programming, Direction Set using Powell's method, Simplex method, Downhill Simplex method, Simplex method with product form inverse, Quasi-Newton method, and others. Commercial products are also available, such as from Lindo Systems, Inc. of Chicago, Ill.

Figure 5:
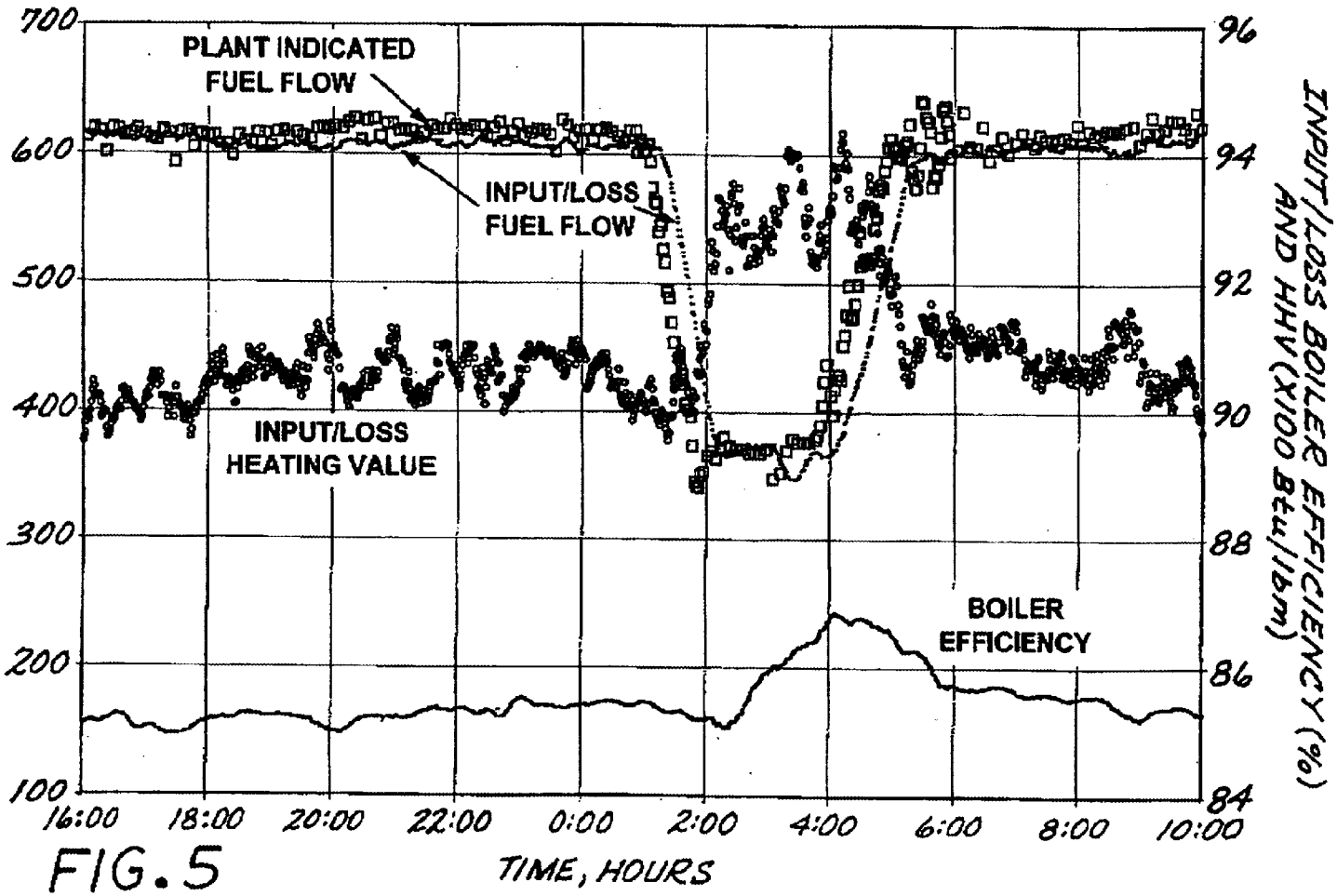
FIG. 5 is a plot of an example of the results of applying this invention at a 600 MWe power plant burning a mix of different Powder River Basin coals.

A further technique applicable to the reduction of instrumentation errors lies with use of neural network technology (herein termed NN). NN technology may be applied to recognize patterns in computed System Effect Parameters influenced by causal Choice Operating Parameters. Much like the aforementioned techniques of the preferred embodiment, NN technology may make corrections to Choice Operating Parameters to achieve a desired result [for example, to minimize the $\lambda_L$, $\lambda_W$ and/or $\lambda_H$ terms of Eqs. (2A), (2B) & (2C)]. Such corrections are based on choosing the highest probability a set of $\Lambda_i$ will produce the lowest errors in System Effect Parameters. An advantage to NN is that such corrections are learned; that is, NN improves its correlations with an ever increasing database. Typically such learning is done without use of an objective function. Specifically, Choice Operating Parameters used to compute fuel chemistries and heating values (leading to boiler efficiency and system heat rate), may be analyzed for their influences on System Effect Parameters, patterns then recognized which then lead directly to corrections being determined via Eq.(1). Given such corrections, Input/Loss methods would proceed as described herein, and in '711, '853, '956 and '527 as applicable. Over-checks may be established which monitor a system's fuel energy flow and indicated fuel flow, comparing the computed with the measured (as illustrated in FIG. 5).

Numerous commercial NN technology software packages are available, for example from: NeuralWare, Pittsburg, Pa.;

California Scientific Software, Nevada City, Calif.; The MathWorks, Inc., Natick, Mass.; those available from universities; and those to be found on the internet. A particularly applicable NN technology is provided by Computer Associates, Islandia, N.Y. comprising their Neugents technology.

However, NN technology is not the preferred embodiment given that such technology is historically intended for large databases, databases representing processes too complex for explicit thermodynamics and/or databases whose applicable objective functions are unknown or otherwise cannot be readily discerned. Even though the teachings of the preferred embodiment of this invention cannot be applied directly using NN technologies, NN technologies have application following the general scope of the present invention.

Alternative Formulations

Although preferred embodiments have been described in the preceding sub-section, various modifications and enhancements may be made without departing from the spirit and scope of the invention. As an example of an alternative technique, an objective function may be formed, consisting of fuel chemistry terms ($\alpha_{MAF-k}$) computed based on uncorrected Choice Operating Parameters, and from Reference Fuel Characteristics (including $\alpha_{MAF/Ref-k}$). Reference Fuel Characteristics include a MAF hydrogen versus MAF carbon relationship; that is an established functional relationship based on historical data. In like manner MAF oxygen versus MAF carbon, MAF nitrogen versus MAF carbon, and MAF sulfur versus MAF carbon may also be consider (although in many situations MAF nitrogen and MAF sulfur may be held constant).

$$F(\vec{x})=\Sigma_{i\epsilon II}(\alpha_{MAF-k}-\alpha_{MAF/Ref-k})/\alpha_{MAF/Ref-k} \tag{20}$$

In Eq.(20) set II is defined as the elements of the fuel chemistry terms, for example: $II=\{\alpha_{MAF-C}, \alpha_{MAF-H}, \alpha_{MAF-O}\}$. This method may use alternative forms, but otherwise relies on fuel concentration terms directly influencing $F(\vec{x})$, and not indirectly via Choice Operating Parameters. This method is not preferred since no use is made of the $R_{Act}$ and $A_{Act}$ terms as might effect the inter-dependency of Choice Operating Parameters (as would then effect System Effect Parameters).

Other alternative approaches involve variations of the formulation of the objective function. The following formulations have been studied with varying degrees of success; they are not preferred.

$$F(\vec{x})=\Sigma_{i\epsilon I}\{S_i[1.0-J_0(\lambda^*)]\} \tag{21}$$

$$F(\vec{x})=\{\Sigma_{i\epsilon I}([S_i-S_iJ_0(\lambda_L)]^2+[S_i-S_iJ_0(\lambda_W)]^2+[S_i-S_iJ_0(\lambda_H)]^2)\}^{1/2} \tag{22}$$

$$F(\vec{x})=\{\Sigma_{i\epsilon I}([S_i\lambda_L]^2+[S_i\lambda_W]^2+[S_i\lambda_H]^2)\}^{1/2} \tag{23}$$

$$F(\vec{x})=\{\Sigma_{i\epsilon I}([S_i\sin(\pi\lambda_L)]^2+[S_i\sin(\pi\lambda_W)]^2+[S_i\sin(\pi\lambda_H)]^2)\}^{1/2} \tag{24}$$

$$F(\vec{x})=\{\Sigma_{i\epsilon I}([S_i-S_i\cos(\pi\lambda_L)]^2+[S_i-S_i\cos(\pi\lambda_W)]^2+[S_i-S_i\cos(\pi\lambda_H)]^2)\}^{1/2} \tag{25}$$

$$F(\vec{x})=\Sigma_{i\epsilon I}S_i(\lambda_L)^2\cdot[1.0-\Pi_{k3}(\lambda_H)^2] \tag{26}$$

$$F(\vec{x})=\Sigma_{i\epsilon I}S_i[\lambda_L+\lambda_W+\lambda_H] \tag{27}$$

$$F(\vec{x})=\Sigma_{i\epsilon I}S_i[\lambda_L\lambda_W\lambda_H] \tag{28}$$

In Eqs.(22) through (28) the $\lambda_L$, $\lambda_W$ and $\lambda_H$ terms are as defined in Eqs.(2A), (2B) & (2C); in Eq.(21) similar terms are defined by the following (System Effect Parameters, $L_{k1}$, $m_{AF}$ & $HHV_{k3}$, are functions of a set of $\Lambda_i$).

$$\lambda_L=L_{k1}/L_{k1-Ref} \tag{29A}$$

$$\lambda_W=m_{AF}/m_{AF-PLT} \tag{29B}$$

$$\lambda_H=HHV_{k3}/HHV_{k3-Ref} \tag{29C}$$

$$\lambda^*\equiv\lambda_L\lambda_W\lambda_H-1.0 \tag{29D}$$

In Eqs.(26) and (29C) subscript k3 refers to As-Fired, Dry and MAF heating values. In Eq.(29A) subscript k1 refers to a chosen L Factor (see Eqs.(71) through (77) and associated discussions). In Eqs.(24) & (25) sin and cos are the trigonometric sine and cosine functions. Associated derivatives and/or Jacobian determinants may be determined as suggested in the preceding sub-section. Further, in developing techniques for objective function formulations, it was found that Simulated Annealing performed satisfactorily for all objectives Functions presented here, and for many hundreds of others studied in developing this invention. Other techniques which minimize differences in System Effect Parameters and their reference values (and/or assign probabilities as an inverse function of such differences), and perform as satisfactorily as Simulated Annealing, include techniques similar in philosophy to Simulated Annealing, including but not limited to Neural Net, Monte Carlo and similar technologies.

The Method Options

Method Options of this invention allow the power plant engineer to choose from individual, or collections, of multidimensional minimization techniques which are suitable for any one of the many operational situations found at a power plant or steam generator. Method Options control the numerical procedures used by the ERR-CALC program; and, as such, only apply when ERR-CALC is executed. Seven Method Options are discussed in TABLE 2.

TABLE 2

Method Options

| Method Option | Suggested Usage |
|---|---|
| BFGS (Option M1) | For routine analysis BFGS is the most robust of techniques. It requires the least trouble in set-up, and it affords the greatest consistency of operation if the system has instrumentation producing consistent signals; rapid computing times are afforded. |
| Generic Conj. Grad. (Option M2) | Generic Conjugate Gradient is an alternative method to BFGS, offering similar robustness but with decreased accuracy. |
| Newton-Raphson (Option M3) | For unique problems in which unusual dependencies exist between $\Lambda_i$ terms (advantaging this technique's incorporation of the Jacobian determinant); also to be employed for scoping new installations after analyzing with Simulated Annealing. |
| Simulated Annealing (Option M4) | For scoping a new installation in which the accuracy of the instrumentation is unknown; constraints on all $\Lambda_i$ terms determined by study of historical data patterns, or as otherwise determined; requires the longest of computing times. |
| BFGS with Sim. Ann. (Option M5) | For situations in which BFGS fails to properly converge (even given rare failures), procedures automatically default to Simulated Annealing. |
| BFGS with Newton-Raphson (Option M6) | For situations in which BFGS fails to properly converge (even given rare failures), procedures automatically default to Newton-Raphson, and then, given failure of Newton-Raphson, |

TABLE 2-continued

| Method Options | |
|---|---|
| Method Option | Suggested Usage |
| | procedures automatically default to Simulated Annealing. |
| Simulated Annealing for Scaling (Option M7) | For computing pre-scaling & scaling factors which may be applied to any other minimization technique; this option to be used only after a converged solution has been established, not for continuous use. |

Systems Options

System Options control the HEATRATE program as to how fuel chemistry is computed (e.g., fixed or variable MAF chemistry). The preferred embodiment of this invention is to provide three System Options, presented in TABLE 3: Fixed MAF Chemistry (Option S1); complete As-Fired fuel chemistry (Option S2); and As-Fired fuel chemistry but with constant MAF fuel ash (Option S3).

System Option S3 allows the MAF molar fuel ash to be computed as a function of MAF heating value ($HHV_{MAF}$); which has been found to have a wide applicability. The following formulation is employed.

$$\alpha_{MAF\text{-}10}=K_{41}+10^{-4}K_{42}HHV_{MAF}+10^{-8}K_{43}(HHV_{MAF})^2 \quad (30)$$

In general, the constants $K_{42}$ and $K_{43}$ are zero, thus setting $\alpha_{MAF\text{-}10}$ equal to the constant $K_{41}$. For some lignite coals, the constants $K_{42}$ and $K_{43}$ have been found to be non-zero. These constants may be based on historical ultimate analyses of the fuel, or as otherwise determined. System Option S3 is recommended only if MAF fuel ash has been determined to be either essentially constant or predictable.

TABLE 3

| System Options | |
|---|---|
| System Options | Suggested Use |
| Fixed MAF Chemistry (Option S1) | Moisture-Ash-Free fuel chemistry is held constant, while fuel water is computed based on the assumption or measurement made for Stack water, fuel ash is computed based on the Air/Fuel ratio or its assumption. Option S1 is intended for a system with poor instrumentation (i.e., serious assumptions being required for certain Choice Operating Parameters). |
| As-Fired Fuel Chemistry (Option S2) | As-Fired fuel chemistry is iterated until consistent with the selected Choice Operating Parameters as based on measurements or assumptions. MAF fuel ash is a computed function of the Air/Fuel ratio. The Air/Fuel ratio is based on inputs from plant data. Option S2 is the most universal, making no simplifying assumptions but may be prone to inconsistent data, thus requiring the periodic use of minimization techniques. |
| As-Fired Fuel Chemistry with Constant Fuel Ash (Option S3) | This option is the same as Option S2, except that MAF fuel ash is held constant or computed as a function of MAF heating value ($HHV_{MAF}$). Option S3 has applicability in all cases where the fuel ash is a relatively Small fraction of the fuel, or as otherwise may be held essentially constant or is predictable via Eq. (30). |

Analysis Options

Analysis Options control the mechanics of computing techniques used by the ERR-CALC program and the Fuel Iterations process. When applying the teachings of this invention, Analysis Options become most important to assure a smooth running Calculational Engine. Six samples of the more important Analysis Options are presented in TABLE 4. In general, these options control when the minimization techniques and/or the Fuel Iterations are to be applied; these options also provide $\Lambda_i$ limit calculations used for Simulated Annealing, and facilitate selection of which Method Option is to be used given failure or non-convergence of an initial Method Option.

An important feature of this invention associated with Analysis Options is that a portion of the Fuel Iterations are duplicated within the ERR-CALC program. Fuel Iterations involving the EX-FOSS and FUEL programs are considered one-half of The Input/Loss Method's principle calculations as taught in '711, HEATRATE being the other half (refer to the detailed discussion of FIG. 2). The FUEL program is a preparatory program to EX-FOSS. Fuel Iterations may require relatively long computing times. For most thermal systems Fuel Iterations are typically performed once every minute to once every 15 minutes; ERR-CALC being executed at this frequency or at longer intervals. Execution frequencies of the Fuel Iterations and the ERR-CALC program are accomplished by selecting different Analysis Options. The Calculational Engine does this automatically once a pattern of Analysis Options is chosen.

When ERR-CALC is executed using either BFGS, generic Conjugate Gradient or Newton-Raphson techniques typically 5 to 50 iterations are required for convergence. However, when ERR-CALC is executed using Simulated Annealing typically over 1000 iterations are required for convergence. To address the problem of long computing times, associated with any Method Option, this invention teaches to duplicate within the ERR-CALC program only those calculations from the EX-FOSS and HEATRATE programs which effect System Effect Parameters, and to therefore compute System Effect Parameters within ERR-CALC (as repeated within the Fuel Iterations). This results in a considerable reduction in computing time required to evaluate repeated objective function calculations. Specifically, these duplicated calculations include HEATRATE stoichiometrics, L Factor calculations, heating value calculations, and an approximation of the effects changing stoichiometrics and changing heating value has on boiler efficiency and thus the effects on computed fuel flow. In summary, these duplicated calculations determine affects on the System Effect Parameters ($L_{k1}$, $m_{AF}$, and $HHV_{k3}$) of a given set of Choice Operating Parameters ($\vec{\Lambda}$).

TABLE 4

| Analysis Options | |
|---|---|
| Analysis Options | Suggested Use |
| Bypass Minimization Techniques & Fuel Iterations (Option A1) | Bypassing the principal calculations allows the EX-FOSS program to compute boiler efficiency with an enhanced frequency (at typically once per 10 seconds), providing rapid feed-back to the system operator. This Option is viable for a natural gas-fired plant, or otherwise with a known or slowly changing fuel chemistry and heating value. |
| Fuel Iterations Without | This option bypasses the ERR-CALC program and uses established correction factors in computing |

TABLE 4-continued

Analysis Options

| Analysis Options | Suggested Use |
|---|---|
| Minimization Techniques (Option A2) | fuel chemistry and heating value. This option should be used during periods between computing correction factors. Typically for example, correction factors could be computed once every day using Option A4, all other times monitoring with Option A2. |
| Correction Factors Only (Option A3) | This option may be used to check-out the computed correction factors (via the ERR-CALC program) before they are applied in determining fuel chemistry and heating values. |
| Fuel Iterations With Minimization Techniques (Option A4) | This option invokes the principal calculations taught by this invention, resolving correction factors, fuel chemistry, heating values, etc.. Given reasonably consistent system instrumentation, this option is intended to be used only periodically, perhaps once per day; but such periodic use will always be dependent on the uniqueness of the system. |
| Special Limits Study (Option A5) | This option establishes lower and upper numerical bounds for the Choice Operating Parameters as applicable to Simulated Annealing by repeatedly varying Choice Operating Parameters until errors are encountered. Such bounds may also be established by the power plant engineer based on measurement records. |
| Force Cycle (Option A6) | This option allows a pre-determined set of Method Options, other System Options, and even other Analysis Options to be invoked based on a defined criteria. Such criteria may be a computational error, faulted instrumentation signal, low thermal loads not applicable for monitoring, highly variable operations and so-forth. It includes not executing (a Calculational Engine cut-out). Also allowed are different sets of combinations of pre-determined Options to be executed sequentially depending on the nature of the criteria. |

Summary

As taught by this invention, the power plant engineer has a wide variety of choices through which differences between System Effect Parameters and their reference values may be minimized by optimizing Choice Operating Parameters. For any given situation found at a thermal system burning fossil fuel, the power plant engineer may exercise the various Method, System and Analysis Options to achieve combustion stoichiometric consistency and thermodynamic conservations. To further assist in teaching this invention, TABLE 5 presents typical applications of this invention. In TABLE 5, the second column denotes the selection of Choice Operating and System Effect Parameters; for example, "$\Lambda_{1S}$ min $L'_{Fuel}$" means that Choice Operating Parameter $\Lambda_{1S}$, see Eq.(11S), is selected to minimize the error in System Effect Parameter $L'_{Fuel}$ of Eq.(72A-alt). The notation "M0", "A0" or "S0" imply that no option is chosen (i.e., none implemented).

Although the present invention has been described in considerable detail with regard to certain preferred embodiments thereof, other embodiments within the scope of the present invention are possible without departing from the spirit and general industrial applicability of the invention. Particularly, additional Choice Operating Parameters may also include any or all of the following quantities, either measured, calculated or otherwise determined: a) relative humidity of combustion air (or other air psychrometric measurements including ambient air temperature); b) feedwater flow (as effecting BBTC); c) reheat flow, either measured or calculated (as effecting BBTC); d) Stack concentration of $SO_2$ (e.g., to address regulatory restraints, or to address the use of limestone or other sorbent); e) Stack concentration of $NO_X$ (e.g., to address regulatory restraints); f) Stack temperature (e.g., which may be controllable if the system is capable of bypassing combustion gas flow through different heat exchangers, commonly gas flows may be controllable between the reheater and the economizer); g) fuel temperature as effected by fuel moisture remove processes; h) an assumed flow of water in-leakage into the combustion gas path (its usefulness being for the monitoring of tube leaks). Also, particularity, additional System Effect Parameters, or further alternatives to those presented, may include any calculational quantity, or any parametric indication from the system's instrumentation, which is sufficiently sensitive to system heat rate. For example, System Effect Parameters may also include the system's indicated total effluent flow at the Stack or Boiler (see region 42 or region 35 in FIG. 1), the system's indicated total energy flow to the working fluid (termed BBTC, see 33 in FIG. 1), and/or the system's indicated combustion air flow (see 25 or 24 in FIG. 1). Also, this invention is not limited to a higher heating value base (gross calorific value), but rather all teachings apply equally to a lower heating value base (net calorific value); '853 teaches preferred methods to compute an accurate boiler efficiency based on either the higher or lower heating values.

Accordingly, the general theme and scope of the appended claims should not be limited to the descriptions of the preferred embodiment disclosed herein.

TABLE 5

Examples of Applications to Different Thermal Systems

| The Thermal System | Optimizations | Method, System & Analysis Options |
|---|---|---|
| Lignite fuel (high ash and high water), low air/fuel ratio, with ≈constant MAF fuel chemistry, all instruments questionable accuracy. | $\Lambda_{1S}$ min $L'_{Fuel}$<br>$\Lambda_{2S}$ min $L'_{Fuel}$<br>$\Lambda_{7S}$ min $L'_{Fuel}$ | M6, S1 and A4 continuously. |
| Initial debug of a new installation: coal with high water, low & constant ash, multiple $O_2$ instruments at Boiler with high accuracy, constant air leakage. | $\Lambda_{1S}$ min $L'_{Fuel}$<br>$\Lambda_{2S}$ min $L'_{Fuel}$<br>$\Lambda_{7B}$ min $L'_{Fuel}$ | M7, S3 and A5 one time, with review of results. |
| Routine monitoring of coal with high water, low & constant ash, multiple $O_2$ instruments at the Boiler with high accuracy, constant air leakage. | $\Lambda_{1S}$ min $L'_{Fuel}$<br>$\Lambda_{2S}$ min $L'_{Fuel}$ | M5, S3 and A4 every 30 minutes; otherwise M0, S0 and A2. |
| Moderate energy coal with variable ash, low fuel water, ≈constant MAF heating value, ambient conditions with variable humidity, tubular air pre-heater having no leakage, $CO_2$ & $O_2$ at Boiler for close control, no $H_2O$ instrument. | $\Lambda_{1B}$ min $HHV_{MAF}$<br>$\Lambda_{1B}$ min $L'_{Fuel}$<br>$\Lambda_{2B}$ min $L'_{Fuel}$<br>$\Lambda_3$ min $L'_{Fuel}$<br>$\Lambda_{7B}$ min $L'_{Fuel}$ | M1 (or M4), S2 and A4 every 15 minutes; otherwise M0, S0 and A2. |
| Fluidized bed combustor with limestone injection, Stack instrumentation, rapid operator feedback required for load following operation. | $\Lambda_{1S}$ min $L'_{Fuel}$<br>$\Lambda_{2S}$ min $L'_{Fuel}$<br>$\Lambda_6$ min $L'_{Fuel}$ | M6, S2 and A3 every hr; otherwise M0, S0 and A1 every 10 seconds. |
| Powder River Basin coal, high & variable fuel water, low fuel ash, highly consistent indicated fuel flow (the computed flow tracks $m_{AF\text{-}PLT}$ over time with $M_w$ = 1.22), multiple $O_2$ at Stack, $H_2O$ & $CO_2$ Stack instruments, constant leakage. | $\Lambda_{1S}$ min $L'_{Fuel}$<br>$\Lambda_{2S}$ min $L'_{Fuel}$<br>$\Lambda_{2S}$ min $m_{AF}$<br>$\Lambda_{7S}$ min $L'_{Fuel}$ | M1, S3 and A4 every hour; otherwise M0, S0 and A2. |
| Natural gas fuel, excellent fuel metering (the computed flow tracks $m_{AF\text{-}PLT}$ over time with $M_w$ = 1.02), | $\Lambda_{1S}$ min $L'_{Fuel}$<br>$\Lambda_{2S}$ min $m_{AF}$<br>$\Lambda_{2S\ min\ mAF}$ | M1, S1 and A4 every 24 hours; otherwise M0, |

TABLE 5-continued

Examples of Applications to Different Thermal Systems

| The Thermal System | Optimizations | Method, System & Analysis Options |
|---|---|---|
| multiple $O_2$ at Boiler, $CO_2$ at Stack, uncertain air leakage, variable water in-leakage. | $\Lambda_4$ min $m_{AF}$ | S0 and A2. |

THE DRAWINGS

FIG. 1 is a schematic representation of a thermal system, particularly a conventional or fluidized bed power plant illustrating use of stoichiometric relationships important in applying this invention to actual systems. It should be studied in conjunction with combustion stoichiometrics terms of Eq.(19-corr). Limestone injection is shown in FIG. 1 which is commonly used in fluidized bed combustors. FIG. 1 depicts a power plant denoted as 20. In this power plant 20, a fuel feed 22 and combustion air 24 are all provided to the upstream side region 26 of the heat exchangers & combustion region 28. Note that this region 28 does not include the air pre-heater 36. In addition, in some types of power plants 20, other materials may be injected into region 26, such as a flow of limestone 31 to minimize effluent $SO_2$ by chemically binding sulfur as $CaSO_4$. Other sorbents may be injected to control sulfur or other pollutants. The fuel feed 22 contains, in general, combustible material, water and mineral matter (called fuel ash). The fuel ash is an unburnable component that passes through the system with little physical change, but which is heated and cooled. In the heat exchangers & combustion region 28, the fossil fuel 22 is burned with the combustion air 24 to form hot combustion products. Heat from the combustion products is transferred to a working fluid 30 that flows through heat exchangers 32 that are depicted as integral with the heat exchangers & combustion region 28. The heated working fluid 30*a* is used in a manner appropriate to a working fluid to generate a useful output 33 (for a conventional power plant such useful output may be supplied to a turbine cycle which could produce electrical power). There may be water in-leakage 29 into the hot combustion products of 28 and/or into region 35, not associated with water in the fuel feed 22 as a result of, for example, soot blowing associated with coal-fired systems or tube leaks from heat exchangers. After leaving the heat exchangers & combustion region 28 on its downstream region 34, the cooler combustion products commonly flow through ducts, region 35, which may contain effluent ash removal equipment, passing then to an air pre-heater 36, where a further portion of the heat energy is transferred to an incoming air stream 38, which air then becomes the combustion air 24. The total air delivered to 20 is the incoming air flow 25. In many cases, an air leakage flow 40 enters the flow of combustion products as it passes through the air pre-heater 36. The further-cooled combustion products leave the air pre-heater 36 and pass to the Stack 42 and are then exhausted to the local environment.

FIG. 1, given its general system description provided above, is applicable to a wide variety of fossil-fired power plants, such coal-burning power plants, oil-burning power plants, gas-fired power plants, biomass combustors, fluidized bed combustors, conventional electric power plants, steam generators, package boilers, combustion turbines, and combustion turbines with heat recovery boilers. This list is not meant to be exhaustive, however, and is presented to illustrate some of the areas of applicability of the present invention. This invention is applicable to all Input/Loss methods. If a thermal system is to be characterized quantitatively using Input/Loss methods, then relationships between Choice Operating Parameters to energy flow inputs and outputs, as in the power plant 20, may be understood with enhanced accuracy using this invention. This understanding, in turn, permits the operation of the thermal system to be optimized for heat rate and pollution reduction. In these systems, some quantities are readily measured with adequate accuracy, and others may not be measured on-line (in real time) with accuracy sufficient to quantify the operation of the power plant 20 to the required accuracy to optimize heat rate. For example, working fluid flow rates, pressures and temperatures may be readily measured with good accuracy by conventional sensors located at defined boundaries such as 30, 30*a*, 25, 33, 42 and 31. Choice Operating Parameters all may, under idea conditions, be directly measured with high accuracy. However, if they are not measured with high accuracy, the ability of Input/Loss methods to quantitatively improve system heat rate may then be compromised. In FIG. 1 quantities leading to (or are) Choice Operating Parameters include: the combustion gas concentrations in the regions 35 and 42 (including $CO_2$, $H_2O$, and $O_2$, termed $\Lambda_{1B}$, $\Lambda_{2B}$, $\Lambda_{7B}$ at region 35, and $\Lambda_{1S}$, $\Lambda_{2S}$, $\Lambda_{7S}$ at region 42); the combustion air flow 24 (when combined with fuel flow then allows the Air/Fuel ratio to be determined, $\Lambda_3$, which allows fuel ash to be computed as taught in '711); the ratio of gas concentrations across the air pre-heater in regions 35 and 42 (preferably the $CO_2$ ratio across these regions, thus allowing the air pre-heater leakage factor $R_{Act}$ to be determined, $\Lambda_4$); the concentration of $O_2$ in the combustion air local to the system and at 25 (termed $A_{Act}$, or $\Lambda_5$, allowing $\phi_{Act}$ to be determined); and the indicated limestone flow 31 ($\Lambda_6$). Refer to Eqs.(11S) through (17B). This invention teaches how to correct such measurements or their assumptions if such measurements are not available.

FIG. 2 illustrates an important portion of this invention, specifically the general calculational sequences associated with optimizing Choice Operating Parameters and subsequent Fuel Iterations when monitoring a fossil-fired thermal system on-line, i.e., in essentially real time. Box 250 represents the data initialization including establishing Reference Fuel Characteristics, data collection, data organization and routine set-ups of all programs. Box 255 depicts the use of the ERR-CALC program, detailed in FIG. 3, which produces corrected Choice Operating Parameters. Box 260 depicts the FUEL program which reduces fuel data from identified multiple sources, prepares a composite fuel, and then prepares an input file for the system simulator EX-FOSS. Reduction of fuel data involves combining the primary (computed) fuel from a previous iteration, with secondary fuels which have constant chemistries, producing a composite fuel. Box 270 is system data supplied to the process as on-line (or real time) data as indicated, including at least the following Operating Parameters (refer to paragraph 0032 for details): working fluid pressures, temperatures and flows, air psychrometrics, useful system output and other related data. Box 280 depicts the system simulator EX-FOSS which, given specification of a composite fuel from FUEL, inputs from Box 270, routine set-up data and corrected Choice Operating Parameters, produces the following: boiler efficiency using the methods of '853, As-Fired fuel flow ($m_{AF}$) per Eq.(63), complete effluent concentrations, system heat rate, effluent flow, emission rates of all effluents including the common pollutants, and other thermal performance parameters including, for example, energy flow to the working fluid (BBTC) and the Firing Correction (HBC). Box 285 depicts the HEATRATE program within which, given the corrected Choice Operating Parameters, produces fuel chemistry, L Factors and fuel heating value for both the composite fuel (as either higher or lower heating values), and, given the fixed compositions of secondary fuels, the composition of the primary fuel. Designation 287 tests for convergence of the process based on the composite fuel moles (x), certain effluents, heating value, and computed fuel water; if convergence criteria is not met the process continues to iterate. In general, convergences are within $0.5\times10^{-4}$ percent of the computed As-Fired fuel moles. Note that the iterations encompassing 260, 270, 280, 285 and 287 define what is meant by the term "Fuel Iterations". Fuel Iterations are defined as the iterative calculations between EX-FOSS, that is as input with fuel chemistry and heating value from a previous iteration but with unknown effluents which are then computed by EX-FOSS (except for effluent is $O_2$ which is input), and HEATRATE as input with known effluents (i.e., the corrected Choice Operating Parameters) but with unknown fuel chemistry and heating value which are then computed by HEATRATE based on effluents. Once converged, Box 294 produces results from the EX-FOSS program, including system heat rate and other thermal performance parameters which include: Second Law analysis of the thermal system (producing Fuel Consumption Indices), fuel flow, total effluent flow, emission rates, other output and reports to system operators what corrective actions may take place; said reports also being provided to regulatory authorities as requested. Box 296 is a decision to turn the process off (quit) or not; in general, monitoring cycles are scheduled for every 2 minutes using updated data based on 15 minute running averages. Box 298 is to quit.

Figure 3:
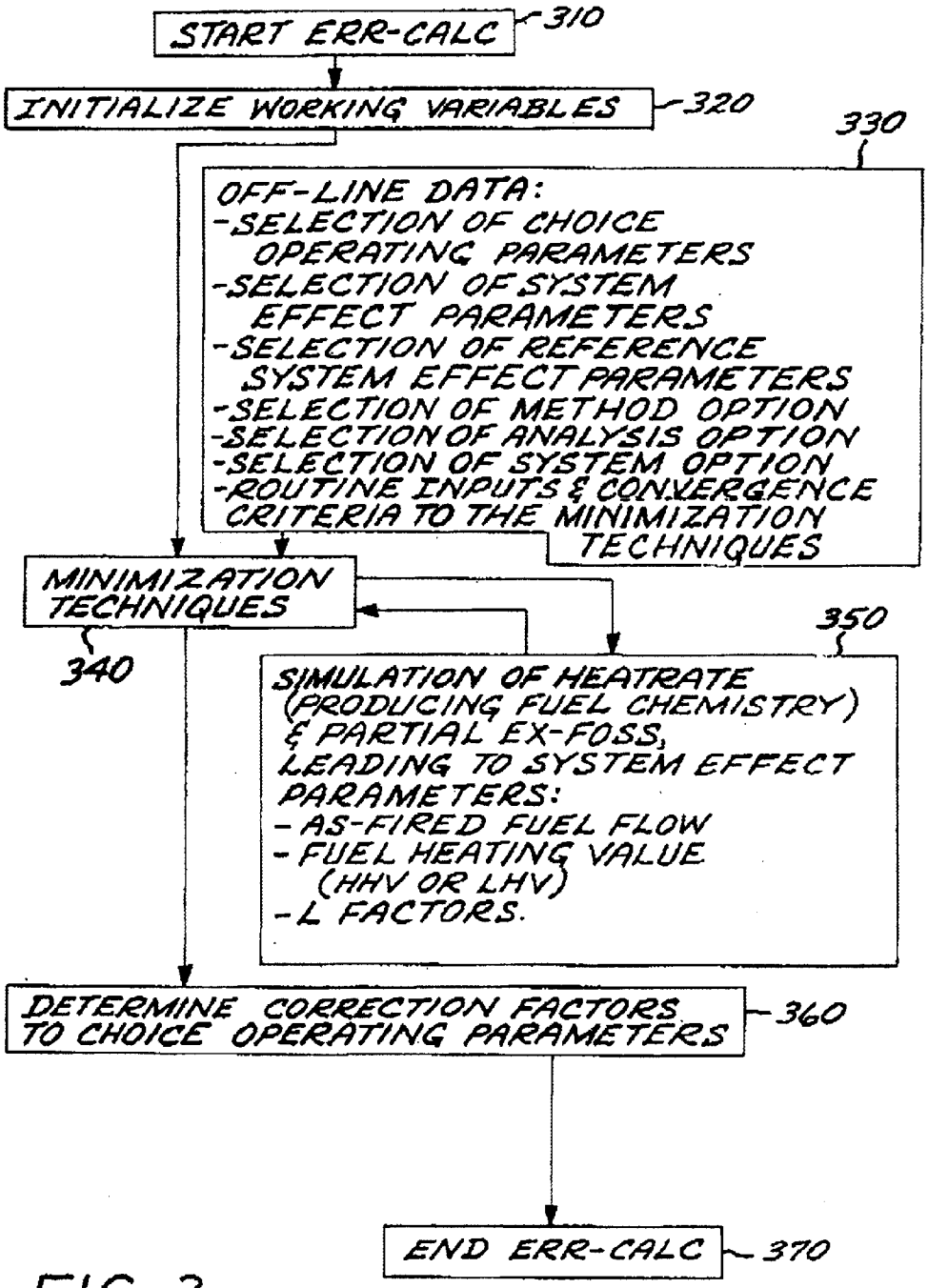
FIG. 3 is a block diagram of the principal functions of the error analysis computer program ERR-CALC which determines corrected Choice Operating Parameters.

FIG. 3 illustrates another important portion of this invention, specifically the organization of the ERR-CALC program used to determine correction factors to the Choice Operating Parameters. In FIG. 3 Box 310 depicts the start of the program which invokes the data initialization including data collection and routine program set-up. Box 320 depicts initializations of data including organization of data arrays associated with selected Choice Operating and System Effect Parameters, and determination of scaling factors, $S_i$, and pre-scaling factors, $s_i$. Box 330 depicts the collection and processing of general input data associated with the minimization techniques, principally the selection of Choice Operating Parameters, the selection of System Effect Parameters, the determination of Reference System Effect parameters, the selection of Options associated with this invention (see TABLES 2, 3 and 4, and examples in TABLE 5), and routine inputs and convergence criteria to the minimization techniques as are known to those skilled in the art using these techniques (such inputs and criteria are presented in cited references, see paragraph 0077, also see paragraphs 0063 and 0067 for discussions of step-length inputs associated with the minimization techniques). Box 340 depicts application of the minimization techniques as herein discussed, including evaluation of an objective function resulting in optimizing the Choice Operating Parameters. Box 350 depicts the use of a simulation of principally the HEATRATE program, and portions of the EX-FOSS program, within ERR-CALC, by which the computing time required for the supporting computations required for Box 340 are greatly reduced; refer to paragraph 0089 for details. For Simulated Annealing, and other such exhaustive procedures, Box 350 is typically caused to be executed from Box 340 thousand of times. Inputs to Box 350 are principally Choice Operating Parameters. Output from Box 350 to Box 340 being principally System Effect Parameters from which the objective function is then evaluated. After convergence of the minimization techniques depicted in Box 340, Box 360 depicts a determination of correction factors to the Choice Operating Parameters, resulting in corrected Choice Operating Parameters. Box 360 also includes the production of appropriate warning messages associated with the ERR-CALC computations; for example: non-convergence, computational failures, the switching to alternative techniques (as described in TABLE 2 and Method Options M5 & M6). Box 370 ends the ERR-CALC program, the process then proceeding back to FUEL and the Fuel Iterations described in FIG. 2.

Figure 4:
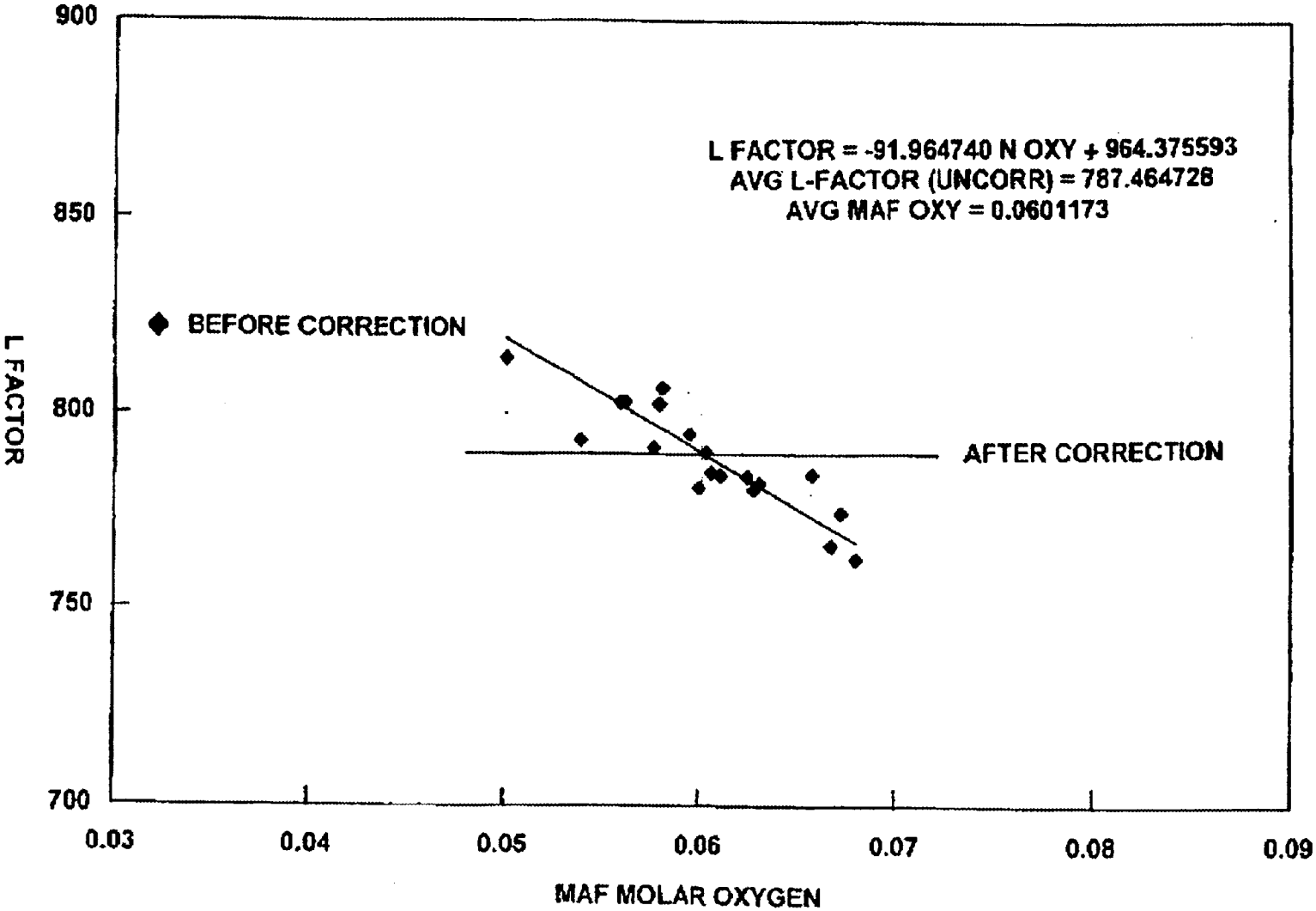
FIG. 4 is a plot of the L Factor versus MAF fuel oxygen associated with Powder River Basin coal which contains $CO_2$ producing mineral matter.

FIG. 4 is a plot of the L Factor, computed using Eq.(72A-alt), versus MAF fuel oxygen as based on actual Powder River Basin coal data, said coal containing $CO_2$ producing mineral matter. Fuel chemistry and heating value data used to compute the L Factor of FIG. 4 were based on historical ultimate analyses. Note that the L Factor has marked bias, but is corrected using the teaching associated with Eq.(77). In FIG. 4, in reference to Eq.(77): the symbol N is the molecular weight of $O_2$, $N_{O2}$; "Oxy" represents the MAF molar fraction of fuel oxygen, $\alpha_{MAF\text{-}O}$; and, where the following constants were developed as a portion of the Reference Fuel Characteristics, $\alpha_{MAF/Ref\text{-}O}$=0.0601173 MAF moles-$O_2$/MAF mole-fuel, and $L''_{Fuel}$=789.464728 lbm-effluent/million-$Btu_{Fuel}$.

FIG. 5 contains time plots of data produced from an installed demonstration of this invention. This installation was at a 600 MWe power plant burning a mix of different Powder River Basin coals; one pulverizer mill processing high energy coal, with six low energy mills. The transient observed in FIG. 5 was caused by a low energy pulverizer mill going off-line, recovered 4 hours later. As seen, the loss of this mill caused a serious upset condition. FIG. 5 illustrates the general sensitivity of The Input/Loss Method. However, of more importance it illustrates results of correcting effluent concentrations, as taught by this invention, thus allowing accurate fuel chemistries and heating values to be determined (even given a rapid changes in the composite fuel). This ability results in reliable computed fuel flows and system heat rates. The plant's indicated fuel flow, $m_{AF\text{-}PLT}$, of FIG. 5 was demonstrated by direct testing at this plant to be unusually accurate, thus justifying a comparison to the computed fuel flow, $m_{AF}$. $m_{AF}$ was computed based on Eq.(63): BBTC/[$\eta_{B\text{-}HHV}$(HHVP+HBC)]. Boiler efficiency was computed as taught in '853. Heating value was computed as taught in '711. BBTC was based on the plant's Operating Parameters. As observed, FIG. 5 indicates remarkable agreement with the indicated fuel flow; as such, the important outputs from The Input/Loss Method, computed heating values and boiler efficiencies, are therefore verified. Note that as the mill was taken off-line $m_{AF}$ lags behind $m_{AF\text{-}PLT}$, this is caused by stored energy associated with the BBTC term (principally stored energy in the turbine cycle's deaerator); later reversing. Computed heating values and boiler efficiencies are dependent on fuel chemistries, which are in turn dependent on corrected Choice Operating Parameters developed using the teachings of this invention. During this transient, the following Options were in use: M1, S3 and A4 applied every 60 minutes (otherwise applying A2); and where only $\Lambda_{1S}$ and $\Lambda_{2S}$ were selected to minimize the error in $L'_{Fuel}$. Eq.(77) was applied to both coals to correct for $CO_2$ producing mineral matter; FIG. 4 is the actual plot of this correction for the low energy coal.

The following summarizes and identifies procedural topics associated with the figures and their specific descriptions used in teaching this invention, in addition, many of these topics are discussed throughout the teachings herein:

selecting a set of minimization techniques applicable to the thermal system and its fuel is demonstrated by Box 330 of FIG. 3, and discussed in TABLE 2 and paragraphs 0062 through 0067;

processing a set of routine inputs and convergence criteria to the minimization techniques is demonstrated by Box 330 of FIG. 3, and discussed in paragraph 0098;

selecting a set of Choice Operating Parameters and their initial values is demonstrated in a Box 330 of FIG. 3, and discussed in paragraph 0070, examples cited in TABLE 5;

determining a set of scaling factors for the set of Choice Operating Parameters resulting in a set of Choice Operating Parameters which are scaled initial values is demonstrated in Box 320 of FIG. 3, and discussed in paragraphs 0052, 0075 and 0076;

determining a set of System Effect Parameters applicable to the thermal system and its fuel whose functionalities effect the determination of system heat rate values is demonstrated in Box 320 of FIG. 3, and discussed in paragraphs 0052, 0054 through 0061, 0075 and 0076;

determining a set of Reference System Effect Parameters which uniquely describe the thermal system and its fuel values is demonstrated in Box 330 of FIG. 3, and discussed in paragraphs 0035 and 0052;

determining an objective function applicable to the thermal system's stoichiometric situation, the set of scaled Choice Operating Parameters, the set of System Effect Parameters and the set of Reference System Effect Parameters values is demonstrated in Box 330 of FIG. 3, and discussed in paragraphs 0050 through 0053 and 0069;

optimizing the set of Choice Operating Parameters using their scaled initial values by employing the set of minimization techniques and the objective function such that the convergence criteria is met resulting in a set of final Choice Operating Parameters values is demonstrated in Boxes 340 and 350 of FIG. 3, and discussed in paragraphs 0082 through 0081;

determining a set of correction factors to the set of Choice Operating Parameters using their initial and final values resulting in a set of corrected Choice Operating Parameters values is demonstrated in Box 360 of FIG. 3, and discussed in paragraph 0061;

determining a fuel heating value of the system using the fuel chemistry values is demonstrated in Box 285 of FIG. 2, and discussed in '711;

determining a Firing Correction base on Operating Parameters values is demonstrated in Box 280 of FIG. 2, and discussed in '853;

determining a boiler efficiency of the thermal system independent of fuel flow using the set of corrected Choice Operating Parameters, the fuel chemistry, the fuel heating value, the Firing Correction and Operating Parameters is demonstrated in Box 280 of FIG. 2, and discussed in '853;

determining an energy flow to the working fluid of the thermal system based on the system's Operating Parameters is demonstrated in Boxes 270 and 280 of FIG. 2, and discussed in 711;

determining a fuel flow of the fuel being combusted using the energy flow to the working fluid, the fuel heating value, the Firing Correction and the boiler efficiency is demonstrated in Box 280 of FIG. 2, and discussed in paragraph 0049 and in '711;

reporting the fuel flow is demonstrated in Box 294 of FIG. 2;

determining a total effluent flow from the thermal system based on the fuel flow, molecular weights of effluents and fuel, and stoichiometric balances based on the set of corrected Choice Operating Parameters is demonstrated in Box 280 of FIG. 2, and discussed in paragraph 0049, in Eqs.(68A) through (70B), and in '711;

reporting the total effluent flow is demonstrated in Box 294 of FIG. 2;

determining a constituent gas concentration in the gaseous effluent found at the system boundary is demonstrated in Box 270 of FIG. 2, and discussed in paragraphs 0033, 0049 and 0070;

determining an emission rate of the constituent gas based on the fuel flow, molecular weights of effluents and fuel, and stoichiometric balances using the set of corrected Choice Operating Parameters is demonstrated in Box 280 of FIG. 2, and discussed in paragraph 0049;

reporting the emission rate of the constituent gas is demonstrated in Box 294 of FIG. 2;

determining a power output from the thermal system is demonstrated in Box 270 of FIG. 2;

determining a system heat rate using the fuel flow, the fuel heating value, the Firing Correction and the power output from the thermal system is demonstrated in Box 280 of FIG. 2, and discussed in paragraph 0049 and Eq.(64A);

determining a system heat rate using the energy flow to the working fluid, the boiler efficiency and the power output from the thermal system is demonstrated in Box 280 of FIG. 2, and discussed in paragraph 0049 and Eq.(64B);

reporting the system heat rate is demonstrated in Box 294 of FIG. 2;

determining a fuel flow rate is demonstrated by Eq.(63);

determining a stoichiometric balance for the combustion process resulting in stoichiometric terms descriptive of Boiler gases, system air leakage and As-Fired fuel is demonstrated by resolution of Eq.(19-corr), and discussed in paragraph 0045 and in '711 and in '853, for example the x, a, $\beta$, $\phi_{Act}$, $j_{Act}$, $b_A$ and $R_{Act}$ terms associated with Eq.(19-corr) are required for the calculation of effluent volumetric flow using ideal gas densities per Eqs.(68A) through (70B) and may be resolved using known art associated with stoichiometric resolutions, or the teachings of '711 and/or '853;

computing a volumetric flow of effluent gases based on the fuel flow rate, results from the stoichiometric balance for the combustion process, and other commonly known parameters is demonstrated by Eqs.(68A) & (68B);

determining a set of Operating Parameters and Reference Fuel Characteristics required for boiler efficiency which includes the energy flow to the working fluid, determining a boiler efficiency of the thermal system following the teachings of '853 following other Input/Loss methods, computing the volumetric flow of effluent gases based on the energy flow to the working fluid, results from the stoichiometric balance for the combustion process, and other commonly in known parameters is demonstrated by Eqs.(69A) & (69B).

Symbols within equations may have been italicized pursuant to Patent Office publication practices. As used in FIGS. 1 through 5, and throughout the above specification, mathematical symbols typed in italics and mathermatical symbols typed in non-italics have the same meaning when taken in context. Understanding context may be afforded through the use of subscripts and/or through the normal flow of mathematical development. Thus, for example, the symbols: $A_{Act}$, l, $R_{Act}$, $F(\vec{x})$, f(), $C_i$, $J_O$, $J_1$, $L_{k1}$, $L_{k1\text{-}Ref}$, $L'_{Fuel}$, $L_{Fuel\text{-}Ref}$, $L'_{Fuel\text{-}Ref}$, $L''_{Fuel\text{-}Ref}$, $L'''_{Fuel\text{-}Ref}$, $L_{Water\text{-}Ref}$, $L'_{Water\text{-}Ref}$, $L_{Ash\text{-}Ref}$, $L'_{Ash\text{-}Ref}$, $m_{AF}$, $x_i$, $\vec{x}$, AF, HR, ER, VF defined in Paragraphs 28 through 31 and elsewhere herein, have the same meaning as, respectively: $A_{Act}$, l, $R_{Act}$, $F(\vec{x})$, f(), $C_i$, $J_O$, $J_l$, $L_{k1}$, $L_{k1\text{-}Ref}$, $L'_{Fuel}$, $L_{Fuel\text{-}Ref}$, $L'_{Fuel\text{-}Ref}$, $L''_{Fuel\text{-}Ref}$, $L'''_{Fuel\text{-}Ref}$, $L_{Water\text{-}Ref}$, $L'_{Water\text{-}Ref}$, $L_{Ash\text{-}Ref}$, $L'_{Ash\text{-}Ref}$, $m_{AF}$, $x_i$, $\vec{x}$, AF, HR, ER, VF. The use of italic symbols is used for writing style. For example, in Eq.(19-corr) the $12^{th}$ letter of the English alphabet describes the concentration of effluent $SO_3$ as $l[SO_3]$. Also in Eq.(19-corr) the $6^{th}$ letter of the English alphabet describes the concentration of effluent $H_2$ as $f[H_2]$; whereas lower-case f (or f) describes a functional relationship, for example as used in Paragraphs 0034, 0053 and 0058. For example, as defined in Paragraph 0028, the letter J (or J) with the subscript "Act" describes the "Total effluent water at the system's boundary ($j_{Act}+b_\Lambda\beta$); moles/base", as opposed to as the letter J (or J) with the subscript "0" or "1", defined in Paragraph 0029, describing the Bessel function of the first kind of order zero or one.

What is claimed is:

1. A method for quantifying the operation of a fossil-fired thermal system through accurate knowledge of its system heat rate and other thermal performance parameters when its fuel chemistry, heating value and fuel flow are determined from Input/Loss methods, the method for quantifying the operation comprising the steps of:

selecting a set of minimization techniques applicable to the thermal system and its fuel, processing a set of routine inputs and convergence criteria to the minimization techniques, selecting a set of Choice Operating Parameters and their initial values, determining a set of scaling factors for the set of Choice Operating Parameters resulting in a set of Choice Operating Parameters which are scaled initial values, determining a set of System Effect Parameters applicable to the thermal system and its fuel whose functionalities effect the determination of system heat rate, determining a set of Reference System Effect Parameters which uniquely describe the thermal system and its fuel, determining an objective function applicable to the thermal system's stoichiometric situation, the set of scaled Choice Operating Parameters, the set of System Effect Parameters and the set of Reference System Effect Parameters, optimizing the set of Choice Operating Parameters using their scaled initial values by employing the set of minimization techniques and the objective function such that convergence criteria is met resulting in a set of final Choice Operating Parameters, determining a set of correction factors to the set of Choice Operating Parameters using their initial and final values resulting in a set of corrected Choice Operating Parameters, and reporting the set of corrected Choice Operating Parameters.

2. The method according to claim 1 further comprising the steps of:

determining a fuel chemistry of the fuel being combusted by the thermal system using Input/Loss methods using the set of corrected Choice Operating Parameters and Operating Parameters, determining a fuel heating value of the system using the fuel chemistry, determining a Firing Correction base on Operating Parameters, determining a boiler efficiency of the thermal system independent of fuel flow using the set of corrected Choice Operating Parameters, the fuel chemistry, the fuel heating value, the Firing Correction and Operating Parameters, determining an energy flow to the working fluid of the thermal system based on the system's Operating Parameters, determining a fuel flow of the fuel being combusted using the energy flow to the working fluid, the fuel heating value, the Firing Correction and the boiler efficiency, and reporting the fuel flow.

3. The method according to claim 2 farther comprising the steps of:

determining a total effluent flow from the thermal system based on the fuel flow, molecular weights of effluents and fuel, and stoichiometric balances based on the set of corrected Choice Operating Parameters, and reporting the total effluent flow.

4. The method according to claim 3 further comprising the steps of:

determining a constituent gas concentration in the gaseous effluent found at the system boundary, determining an emission rate of the constituent gas based on the fuel flow, molecular weights of effluents and fuel, and stoichiometric balances based on the set of corrected Choice Operating Parameters, and reporting the emission rate of the constituent gas.

5. The method of claim 1, wherein the step of determining a set of scaling factors for the set of Choice Operating Parameters includes additional steps of:

assuming the set of scaling factors are all unity, determining a set of System Effect Parameters applicable to the thermal system and its fuel whose functionalities effect the determination of system heat rate, determining a set of Reference System Effect Parameters which uniquely describe the thermal system and its fuel, determining an objective function applicable to the thermal system's stoichiometric situation, the set of scaled Choice Operating Parameters, the set of System Effect Parameters and the set of Reference System Effect Parameters, optimizing the set of Choice Operating Parameters using their initial values by employing a Simulated Annealing algorithm from the set of minimization techniques and the objective function such that numerical differences between the set of System Effect Parameters and the set a Reference System Effect Parameters met convergence criteria resulting in a set of final Choice Operating Parameters, finding a smallest final Choice Operating Parameter from the set of final Choice Operating Parameters, and determining a set of scaling factors based on the smallest final Choice Operating Parameter.

6. The method of claim 1, wherein the step of determining the objective function comprises a step of:

forming an objective function dependent on the Bessel Function.

7. The method of claim 1, wherein the step of determining the objective function comprises a step of:

forming an objective function dependent on trigonometric sine and cosine functions.

8. The method according to claim 2 further comprising the steps of:

determining a power output from the thermal system, determining a system heat rate using the fuel flow, the fuel heating value, the Firing Correction and the power output from the thermal system, and reporting the system heat rate.

9. The method according to claim 2 further comprising the steps of:

determining a power output from the thermal system, determining a system heat rate using the energy flow to the working fluid, the boiler efficiency and the power output from the thermal system, and reporting the system heat rate.

10. The method of claim 1, wherein the step of selecting a set of minimization techniques applicable to the thermal system and its fuel comprises a step of:

including a BFGS technique.

11. The method of claim 1, wherein the step of selecting a set of minimization techniques applicable to the thermal system and its fuel comprises a step of:

including a Simulated Annealing technique.

12. The method of claim 1, wherein the step of selecting a set of minimization techniques applicable to the thermal system and its fuel comprises a step of:

including a neural network technique.

13. The method of claim 1, wherein the step of selecting a set of minimization techniques applicable to the thermal system and its fuel comprises a step of:

including a Neugents technology.

14. A method for quantifying the operation of a fossil-fired thermal system through accurate knowledge of its system heat rate and other thermal performance parameters when its fuel chemistry, heating value and fuel flow are determined from Input/Loss methods, the method for quantifying the operation comprising the steps of:

selecting a neural network technique applicable to the thermal system and its fuel, processing a set of routine inputs and convergence criteria to the neural network technique, selecting a set of Choice Operating Parameters and their initial values, determining a set of System Effect Parameters applicable to the thermal system and its fuel whose functionalities effect the determination of system heat rate, optimizing the set of Choice Operating Parameters by employing the neural network technique such that convergence criteria is met resulting in a set of final Choice Operating Parameters, determining a set of correction factors to the set of Choice Operating Parameters using their initial and final values resulting in a set of corrected Choice Operating Parameters, and reporting the set of corrected Choice Operating Parameters.

15. The method of claim 14, wherein the step of selecting the neural network technique applicable to the thermal system and its fuel comprises a step of:

including a Neugents technology.

16. The method according to claim 14 further comprising the steps of:

determining a fuel chemistry of the fuel being combusted by the thermal system using Input/Loss methods using the set of corrected Choice Operating Parameters and Operating Parameters, determining a fuel heating value of the system using the fuel chemistry, determining a Firing Correction base on Operating Parameters, determining a boiler efficiency of the thermal system independent of fuel flow using the set of corrected Choice Operating Parameters, the fuel chemistry, the fuel heating value, the Firing Correction and Operating Parameters, determining an energy flow to the working fluid of the thermal system based on the system's Operating Parameters, determining a fuel flow of the fuel being combusted using the energy flow to the working fluid, the fuel heating value, the Firing Correction and the boiler efficiency, and reporting the fuel flow.

17. The method according to claim 16 further comprising the steps of:

determining a total effluent flow from the thermal system based on the fuel flow, molecular weights of effluents and fuel, and stoichiometric balances based on the set of corrected Choice Operating Parameters, and reporting the total effluent flow.

18. The method according to claim 17 further comprising the steps of:

determining a constituent gas concentration in the gaseous effluent found at the system boundary, determining an emission rate of the constituent gas based on the fuel flow, molecular weights of effluents and fuel, and stoichiometric balances based on the set of corrected Choice Operating Parameters, and reporting the emission rate of the constituent gas.

19. A method for quantifying the operation of a fossil-fired thermal system by computing the volumetric flow of effluent gases, the method for quantifying the operation comprising the steps of:

determining a fuel flow rate, determining a stoichiometric balance for the combustion process resulting in stoichiometric terms descriptive of Boiler gases, system air leakage and As-Fired fuel, determining an average molecular weight of the effluent gases, determining a molecular weight of the As-Fired fuel, determining an ideal gas density, computing the volumetric flow of effluent gases based on the fuel flow rate, results from the stoichiometric balance for the combustion process, the average molecular weight of the effluent gases, the molecular weight of the As-Fired fuel and the ideal gas density, and reporting the volumetric flow.

20. A method for quantifying the operation of a fossil-fired thermal system by computing the volumetric flow of effluent gases, the method for quantifying the operation comprising the steps of:

determining an energy flow to the working fluid, determining a set of Operating Parameters required for boiler efficiency, determining a set of Reference Fuel Characteristics descriptive of a typical fuel including a typical heating value, determining a stoichiometric balance for the combustion process based on the set of Operating Parameters and the set of Reference Fuel Characteristics resulting in stoichiometric terms descriptive of Boiler gases, system air leakage and As-Fired fuel, determining an average molecular weight of the effluent gases, determining a molecular weight of the As-Fired fuel, determining a boiler efficiency of the thermal system, determining an ideal gas density, computing the volumetric flow of effluent gases based on the energy flow to the working fluid, the set of Operating Parameters, the set of Reference Fuel Characteristics, results from the stoichiometric balance for the combustion process, the average molecular weight of the effluent gases, the molecular weight of the As-Fired fuel, the boiler efficiency and the ideal gas density, and reporting the volumetric flow.

* * * * *

UNITED STATES PATENT AND TRADEMARK OFFICE

CERTIFICATE OF CORRECTION

PATENT NO. : 6,714,877 B1
DATED : March 30, 2004
INVENTOR(S) : Lang

It is certified that error appears in the above-identified patent and that said Letters Patent is hereby corrected as shown below:

Title page,
Item [*] Notice, please delete info and insert the following:
-- Subject to any disclaimer, the term of this patent is extended or adjusted under 35 U.S.C. 154 by 212 days --.

Column 2,
Lines 23 through 26, delete "U.S. patent applications: Ser. No. 09/273,711 (hereinafter termed '711), Ser. No. 09/630,853 (hereinafter termed '853), Ser. No. 09/827,956 (hereinafter termed '956), and Ser. No. 09/971,527 (hereinafter termed '527);" and insert -- U.S. patent applications and resulting patents: Ser. No. 09/273,711 which issued February 18, 2003 as 6,522,994 (hereinafter termed '711); Ser. No. 09/630,853 which issued June 24, 2003 as 6,584,429 (hereinafter termed '853); Ser. No. 09/827,956 which issued May 6, 2003 as 6,560,563 (hereinafter termed '956); and Ser. No. 09/971,527 (hereinafter termed '527); --.

Column 6,
Line 13, delete "a = Molar fraction" and insert -- a = Moles --.
Line 16, delete "mole/base" and insert -- moles/base --.
Line 17, delete "$a_{Dry\text{-}theor}$ = Molar fraction" and insert -- $a_{Dry\text{-}theor}$ = Moles --.

Column 7,
Line 1, delete "z = Moles of $H_2O$ per" and insert -- z = Moles of $H_2O$ per moles of --.
Line 12, embedded equation reading, "$\beta \equiv (R_{Act}\text{-}1.0)/[aR_{Act}(1.0+\phi_{Act})]$" should read as follows: -- $\beta \equiv 100(R_{Act}\text{-}1.0)/[aR_{Act}(1.0+\phi_{Act})]$ --.

Column 8,
Line 21, embedded equation reading, " $\vec{\Lambda} = (\Lambda_1 S, \Lambda_{2S}, \Lambda_3, \Lambda_6, \Lambda_{7B})$ " should read as follows: -- $\vec{\Lambda} = (\Lambda_{1S}, \Lambda_{2S}, \Lambda_3, \Lambda_6, \Lambda_{7B})$ --.

Line 59, delete "$\eta_{B\text{-}HHV}$ or $\eta_{B\text{-}HHV}$; unitless." and insert -- $\eta_{B\text{-}HHV}$ or $\eta_{B\text{-}LHV}$; unitless. --.

Column 10,
Lines 35-36, embedded equation reading, "$\alpha_{MAF\text{-}10} = f(HHV_{MAF})$" should read as follows: -- $\alpha_{MAF\text{-}10} = f(HHV_{MAF})$ --.

Column 11,
Line 51, delete "as a. Choice" and insert -- as a Choice --.

UNITED STATES PATENT AND TRADEMARK OFFICE

CERTIFICATE OF CORRECTION

PATENT NO. : 6,714,877 B1
DATED : March 30, 2004
INVENTOR(S) : Lang

It is certified that error appears in the above-identified patent and that said Letters Patent is hereby corrected as shown below:

Column 12,
Line 2, delete "using. The Input/Loss Method" and insert -- using The Input/Loss Method --.

Column 13,
Table 1 between lines 9-32, should read as follows,

-- TABLE 1:
Mass Balance of a Fossil-Fired Thermal System

Fuel Flow Rate ( $m_{AF}$ ) $= BBTC / [\eta_{B\text{-}HHV} (HHVP + HBC)]$
Combustion Dry Air Flow Rate $= m_{AF} (1.0 + \beta) (a + a\, \phi_{Act}) N_{Dry\text{-}Air} / (xN_{AF})$
Combustion Air Moisture Flow Rate $= m_{AF} (1.0 + \beta)\, b_A\, N_{H2O} / (xN_{AF})$
In-Leakage of Water and Steam $= m_{AF}\, b_Z\, N_{H2O} / (xN_{AF})$
Pure LimeStone (PLS) Injected $= \dfrac{m_{AF} (1.0 + \gamma)\, b_{PLS}\, N_{CaCO3} / (xN_{AF})}{\sum \text{INLET MASS FLOWS}}$ Dry Gas Flow as Boiler Effluent $= m_{AF}\, 100\, N_{Dry\text{-}Boiler\text{-}Gas} / (R_{Act}\, xN_{AF})$
Dry Air Leakage Flow at Boundary $= m_{AF}\, a\beta\, (1.0 + \phi_{Act})\, N_{Dry\text{-}Air} / (xN_{AF})$
Combustion Moisture plus Air
Leakage Moisture at Boundary $= m_{AF} (j_{Act} + \beta b_A)\, N_{H2O} / (xN_{AF})$
Calcium Sulfate with Water from PLS $= m_{AF}\, \sigma\, b_{PLS}\, N_{CaSO4.zH2O} / (xN_{AF})$
Calcium Oxide from PLS Injection and,
optionally, from Fuel Carbonates $= m_{AF} [(1.0 - \sigma + \gamma) b_{PLS} + x\alpha_{CaCO3}] N_{CaO} / (xN_{AF})$
Carbon in Ash Flow $= m_{AF}\, v\, N_C / (xN_{AF})$
Ash Flow (Bottom Ash, Fly
Ash and Dust) $= \dfrac{m_{AF}\, \alpha_{10}\, N_{Ash} / N_{AF}}{\sum \text{OUTLET MASS FLOWS}}$ --

Line 62, delete "$\Phi_i$ is the molar fraction" and insert -- $\Phi_i$ are the moles --.

Column 14,
Line 39, delete "volumetric flows are equivalent" and insert -- volumetric flows are given by Eqs.(68A) & (68B). --.
Equation (68A) should read as follows:
-- $VF_{Dry}=100 m_{AF} N_{Dry\text{-}Gas}/(\rho_{Dry\text{-}Gas}\, xN_{AF})$ (68A) --.
Equation (68B) should read as follows:
-- $VF_{Wet}=[100 m_{AF} N_{Wet\text{-}Gas}/(\rho_{Wet\text{-}Gas}\, xN_{AF})]$
$[100/(100+ j_{Act} + \beta b_A)]$ (68B) --.
Equation (69A) should read as follows:
-- $VF_{Dry}=100 BBTC\, N_{Dry\text{-}Gas}/[\rho_{Dry\text{-}Gas}\, xN_{AF}\, \eta_{B\text{-}HHV} (HHVP+HBC)]$ (69A) --.

UNITED STATES PATENT AND TRADEMARK OFFICE

CERTIFICATE OF CORRECTION

PATENT NO. : 6,714,877 B1
DATED : March 30, 2004
INVENTOR(S) : Lang

It is certified that error appears in the above-identified patent and that said Letters Patent is hereby corrected as shown below:

Column 14 (cont'd),
Equation (69B) should read as follows:

-- $VF_{Wet}=\{100BBTC\ N_{Wet\text{-}Gas}/[\rho_{Wet\text{-}Gas}\, xN_{AF}\, \eta_{B\text{-}HHV}\,(HHVP+HBC)]\}$
$[100/(100+j_{Act}+\beta b_A)]$ (69B) --.

Equation (70B) should read as follows:

-- $\rho_{Wet\text{-}Gas}=[(100/R_{Act})N_{Dry\text{-}Boiler\text{-}Gas}+a\beta(1.0+\phi_{Act})N_{Dry\text{-}Air}$
$+(j_{Act}+\beta b_A)N_{H2O}]/[(100+j_{Act}+\beta b_A)(385.321)]$ (70B) --.

Column 15,
Line 44, delete "important (and sensitivity)" and insert -- important (and sensitive) --.

Column 27,
Equation (23) should read as follows:

$$F(\vec{x}) = \{\sum_{i \in I} ([S_i\, \lambda_L]^2 + [S_i\, \lambda_W]^2 + [S_i\, \lambda_H]^2)\}^{1/2} \qquad (23)$$

Column 34,
Lines 57-58, delete "(refer to paragraph 0032 for details)" and insert -- (refer to the section marked Meaning of Terms) --.

Column 35,
Lines 55-56, delete "see paragraph 0077, also see paragraphs 0063 and 0067" and insert -- see above --.
Line 65, delete "refer to paragraph 0089 for details" and insert -- refer to the section marked Analysis Options --.

Column 39,
Lines 10-20, the complete sentence should read as follows:

-- Thus, for example, the symbols: $A_{Act}$, $l$, $R_{Act}$, $F(\vec{x})$, $f(\,)$, $C_i$, $J_0$, $J_1$, $L_{k1}$, $L_{k1\text{-}Ref}$, $L'_{Fuel}$, $L_{Fuel\text{-}Ref}$, $L'_{Fuel\text{-}Ref}$, $L''_{Fuel\text{-}Ref}$, $L'''_{Fuel\text{-}Ref}$, $L_{Water\text{-}Ref}$, $L'_{Water\text{-}Ref}$, $L_{Ash\text{-}Ref}$, $L'_{Ash\text{-}Ref}$, $m_{AF}$, $x_i$, $\vec{x}$, $AF$, $HR$, $ER$, $VF$ defined elsewhere herein, have the same meaning as, respectively: $A_{Act}$, $l$, $R_{Act}$, $F(\vec{x})$, $f(\,)$, $C_i$, $J_0$, $J_1$, $L_{k1}$, $L_{k1\text{-}Ref}$, $L'_{Fuel}$, $L_{Fuel\text{-}Ref}$, $L'_{Fuel\text{-}Ref}$, $L''_{Fuel\text{-}Ref}$, $L'''_{Fuel\text{-}Ref}$, $L_{Water\text{-}Ref}$, $L'_{Water\text{-}Ref}$, $L_{Ash\text{-}Ref}$, $L'_{Ash\text{-}Ref}$, $m_{AF}$, $x_i$, $\vec{x}$, AF, HR, ER, VF. --

UNITED STATES PATENT AND TRADEMARK OFFICE

CERTIFICATE OF CORRECTION

PATENT NO. : 6,714,877 B1
DATED : March 30, 2004
INVENTOR(S) : Lang

It is certified that error appears in the above-identified patent and that said Letters Patent is hereby corrected as shown below:

Column 39 (cont'd),
Lines 23-32, the complete two sentences should read as follows:
-- Also in Eq.(19-corr) the $6^{th}$ letter of the English alphabet describes the concentration of effluent $H_2$ as $f[H_2]$; whereas lower-case *f* (or f) describes a functional relationship, for example as used in the section marked Meaning of Terms. For example, as defined in the section marked Definitions of Equation Terms with Typical Units of Measure, the letter J (or *J*) with the subscript 'Act' describes the 'Total effluent water at the system's boundary ($j_{Act} + b_A\beta$); moles/base'; as opposed to as the letter *J* (or J) with the subscript '0' or '1', for example as used in Eq.(3), describing the Bessel function of the first kind of order zero or one. --.

Signed and Sealed this

Twenty-ninth Day of November, 2005

JON W. DUDAS
*Director of the United States Patent and Trademark Office*